United States Patent [19]

Hall

[11] Patent Number: 4,977,995

[45] Date of Patent: Dec. 18, 1990

[54] COIN CHUTE CONSTRUCTION

[75] Inventor: Mitchell A. Hall, Ft. Thomas, Ky.

[73] Assignee: Monarch Tool & Manufacting Company, Covington, Ky.

[21] Appl. No.: 166,401

[22] Filed: Mar. 10, 1988

Related U.S. Application Data

[60] Continuation-in-part of Ser. No. 928,878, Nov. 10, 1986, Pat. No. 4,799,580, which is a division of Ser. No. 623,574, Jun. 22, 1984, Pat. No. 4,640,405.

[51] Int. Cl.[5] ..... G07F 5/06

[52] U.S. Cl. ..... 194/235; 194/257

[58] Field of Search ..... 194/202, 203, 235, 238, 194/253, 291, 257

[56] References Cited

U.S. PATENT DOCUMENTS

| | | | |
|---|---|---|---|
| 3,265,179 | 8/1966 | Luke | 194/253 |
| 3,732,962 | 5/1973 | Hall | 194/238 |
| 4,098,385 | 7/1978 | McNally | 194/235 |
| 4,640,405 | 2/1987 | Hall | 194/235 |

*Primary Examiner*—F. J. Bartuska

*Attorney, Agent, or Firm*—Kinney & Schenk

[57] ABSTRACT

A coin chute construction for a dispensing machine and method of making same are provided wherein such machine requires at least one coin of predetermined size and valuation to initiate one operation of the machine for one item of goods or service. The construction comprises improved structural components associated with holding, moving, and testing each coin at a test station; and a coin knockout device which prevents a coin jammed in a slider of the machine from being used to provide more than one operation of such machine.

28 Claims, 12 Drawing Sheets

8
52
9
52
50
10
122
64
64
117
130
125
126
110
130
34
73
131
105
105
72
72
73
37
37
151
150
152
22
158
152
147
9
8
10
159
146
153

117
36
135
133
142
35
140
34
153
156
158
159
47

117
135
133
143
36
35
140
34
157
153
47
159
158

135
144
34
36
35
140
133

FIG-14
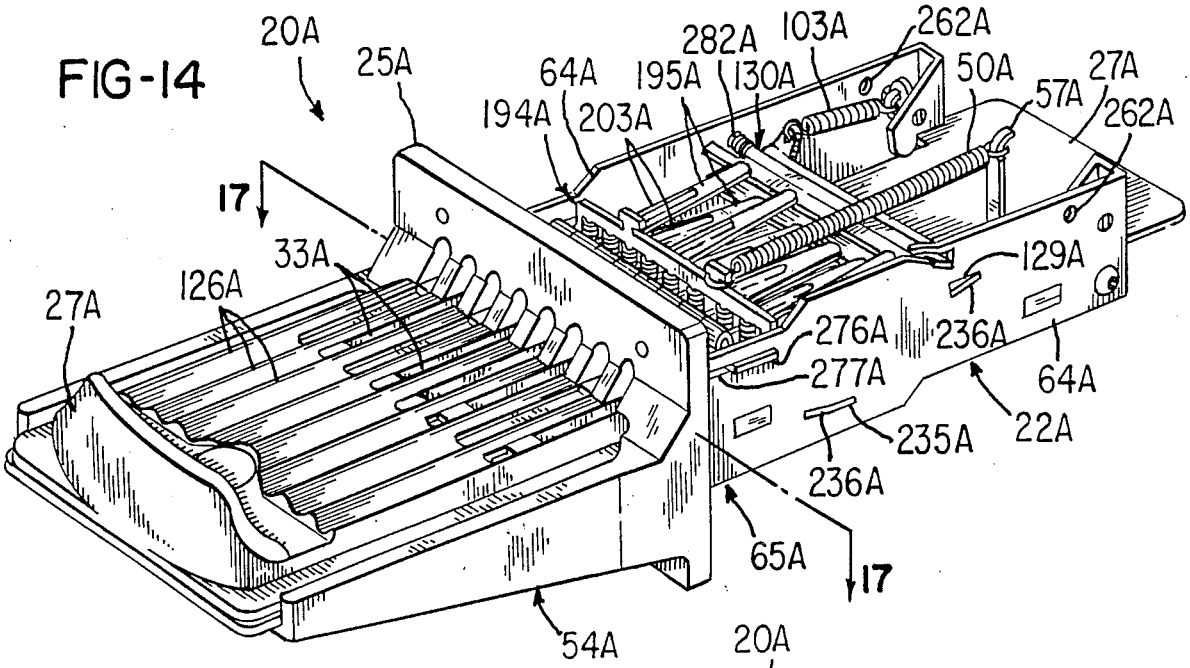
FIG-15
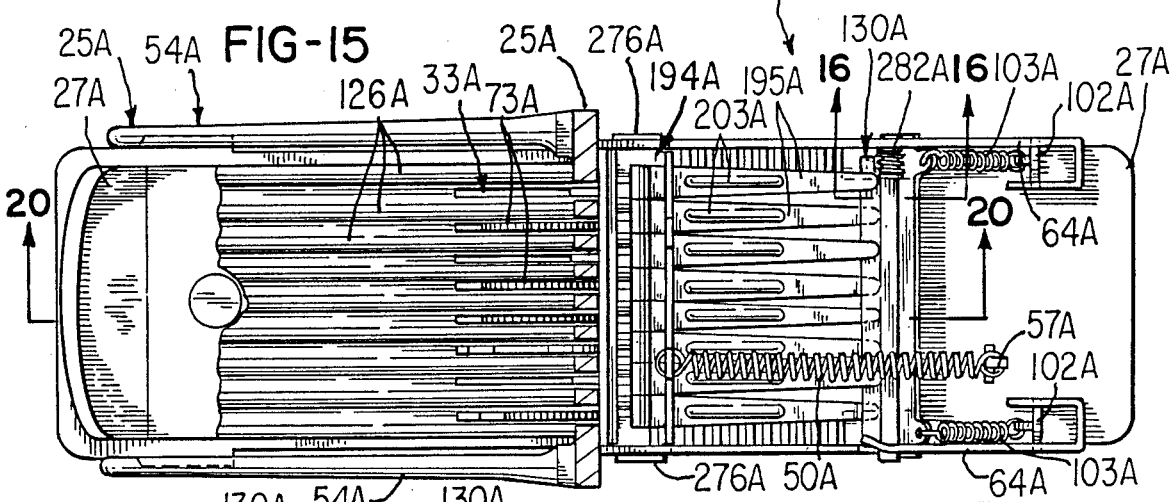
FIG-16
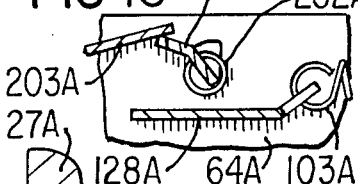
FIG-17
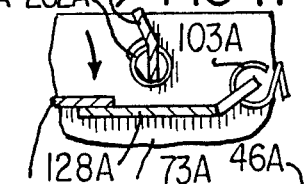
FIG-18
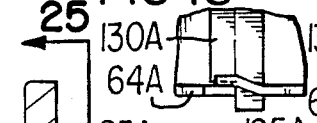
FIG-19
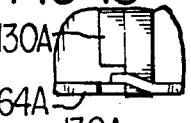
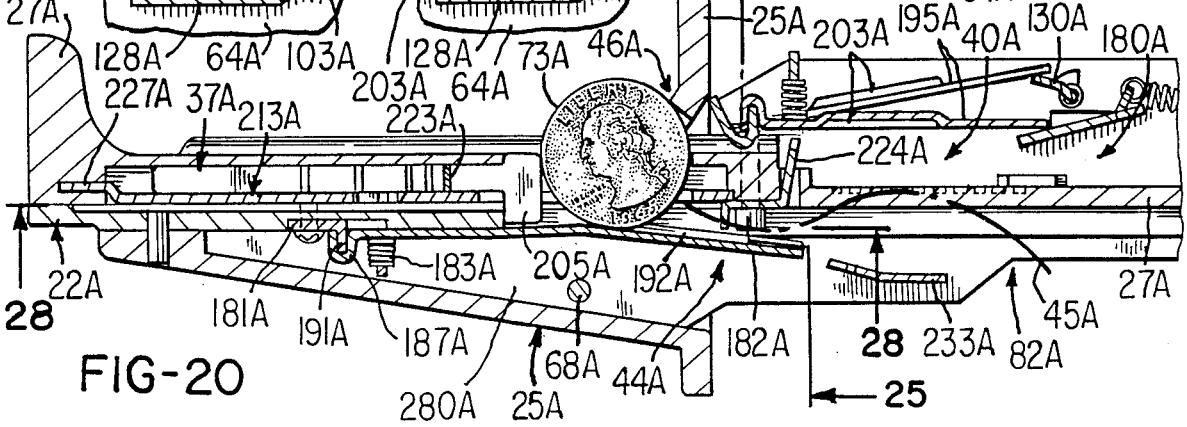
FIG-20

20A
25A
202A
196A
64A
26
195A
130A
282A
126A
201A
203A
128A
27A
37A
144A
143A
194A
230A
213A
206A
210A
103A
224A
135A
142A
223A
205A
40A
27A
25A
183A
182A
241A
73A
65A
68A
192A
233A
82A
26

27A
194A
202A
196A
64A
282A 25A
201A
203A
195A
130A
103A
126A
210A
223A
128A
227A
213A
37A
144A
143A
230A
224A
183A
135A
182A
192A
141A
205A
251A
247A
65A
27A
187A
191A
185A
25A
68A
253A
250A
245A
233A
246A
234A 27A
25A
202A
196A
282A 194A
201A
203A
195A
130A
103A
126A
210A
142A
128A
227A
213A
37A
144A
223A
230A
224A
183A
135A
182A
192A
141A
205A
251A
247A
65A
27A
187A
191A
185A
25A
68A
252A
250A
246A
245A
233A
234A 27A
25A
202A
196A
203A
195A
130A
282A
103A 194A
227A
213A
37A
126A
223A
205A
230A
224A
128A
183A
135A
182A
233A

FIG-25
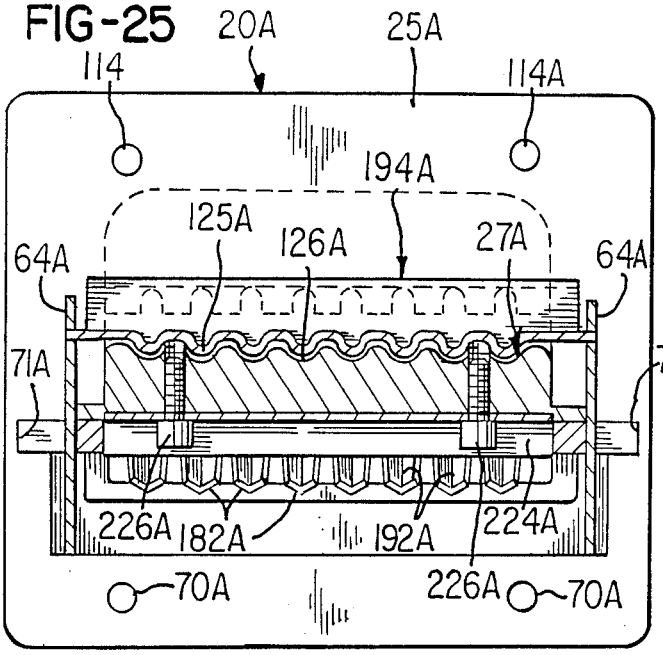
FIG-27
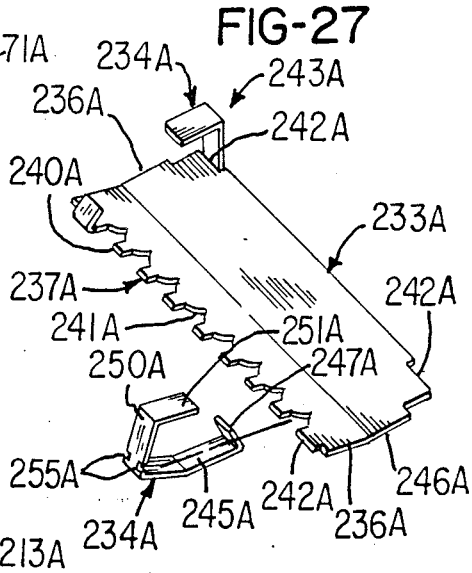
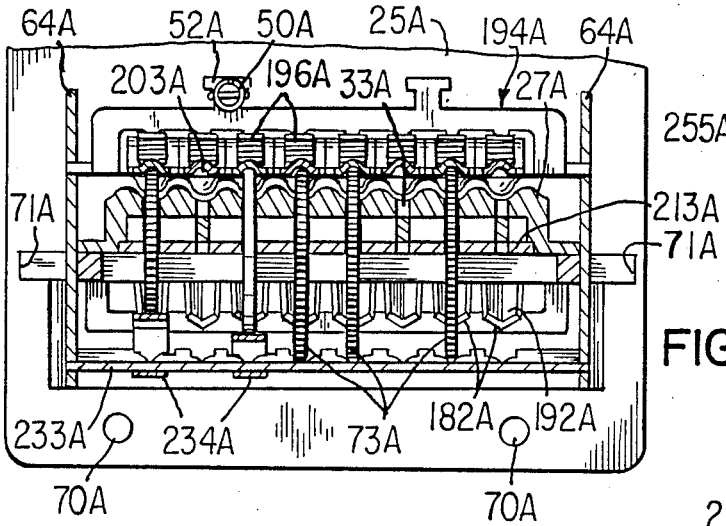
FIG-26
FIG-28
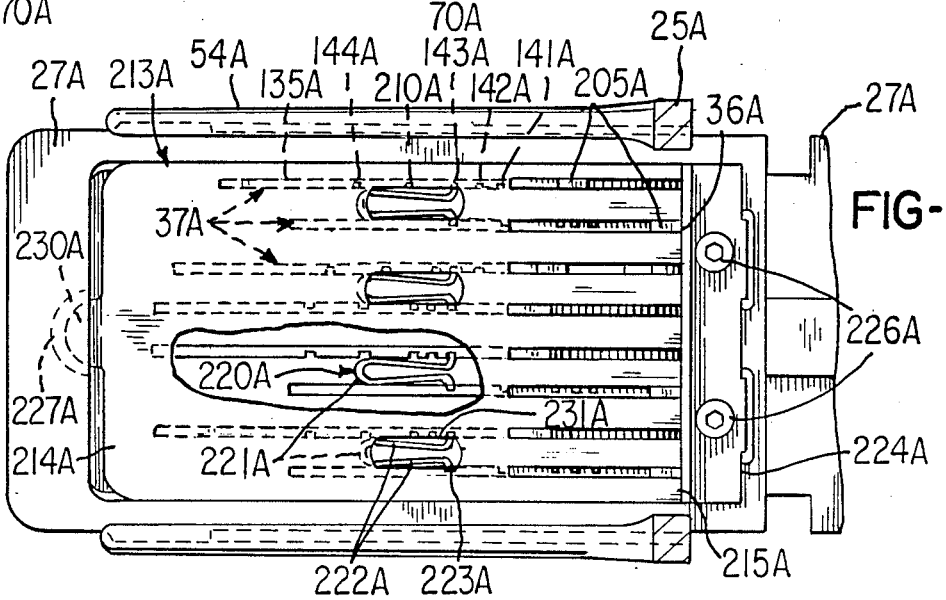

68A
114A
25A
20A
67A
280A
71A
277A
276A
64A
68A
194A
235A
129A
201A
125A
262A
197A
97A
70A
52A
196A
54A
276A
203A
282A
71A
195A
196A
126A
202A
130A
33A
50A
200A
233A
236A
236A
72A
234A
128A
37A
104A
103A
135A
57A
102A
206A
205A
214A
27A
230A
133A
220A
36A
217A
33A
215A
213A
216A
224A
218A
65A
226A
23A
280A
277A
64A
68A
129A
262A
70A
235A
184A
97A
187A
24A
183A
192A
185A
182A
181A
85A
191A
85A

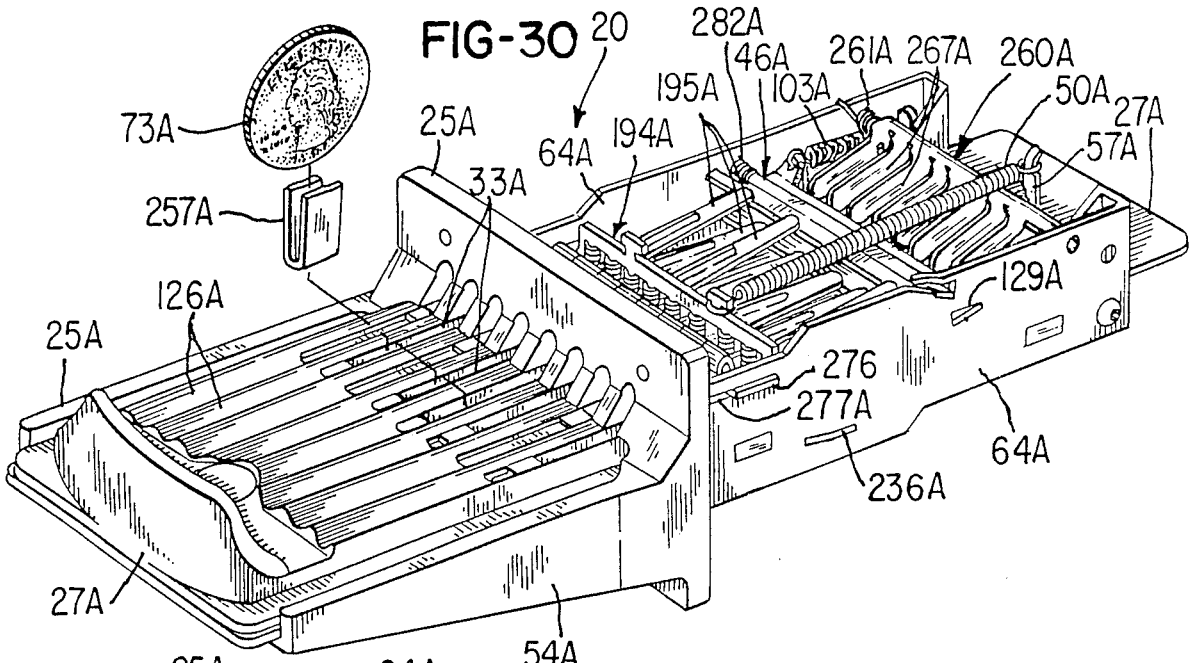
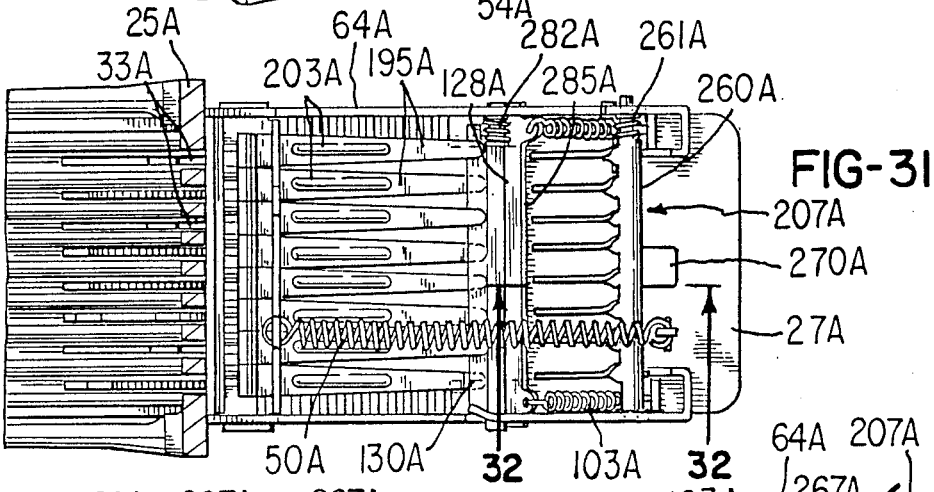
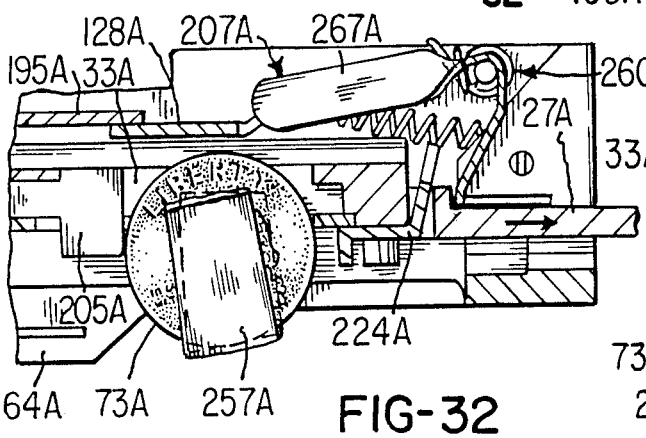
FIG-32
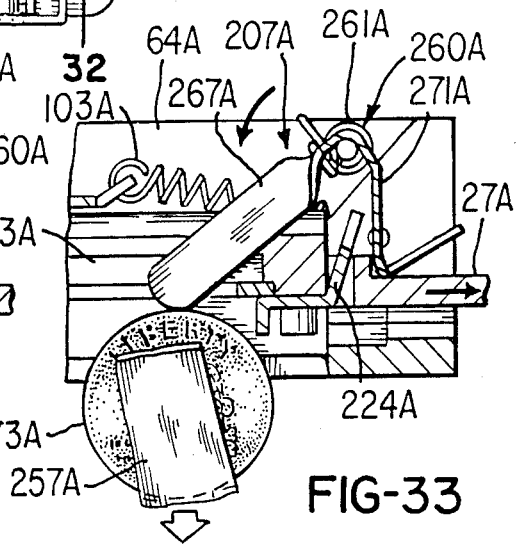
FIG-33

207A
261A
260A
267A
64A
103A
128A
27A
37A
205A
33A
224A
126A
33A
27A
37A
104A
135A
211A
206A
210A
205A
212A
230A
214A
220A
217A
36A
218A
33A
213A
215A 216A
224A 20A
133A
226A
25A
213A
54A
206A
210A
223A
205A
27A
33A
224A
37A
135A
230A
226A
220A
227A
221A
231A
213A
214A
36A
222A
223A

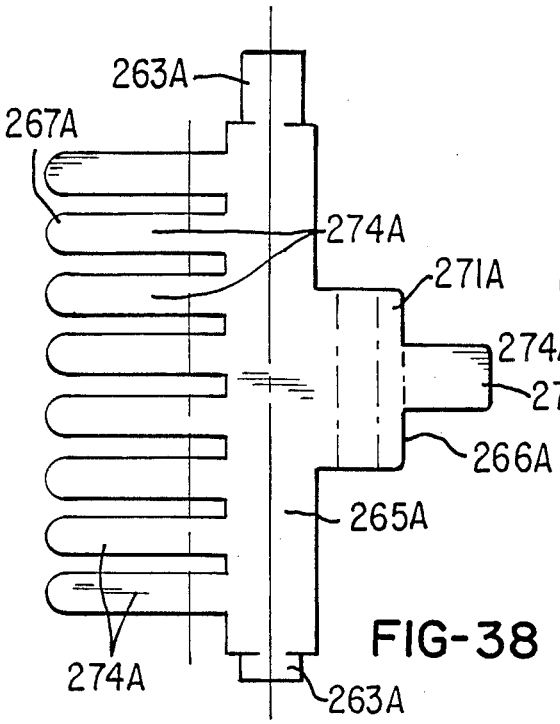
FIG-38
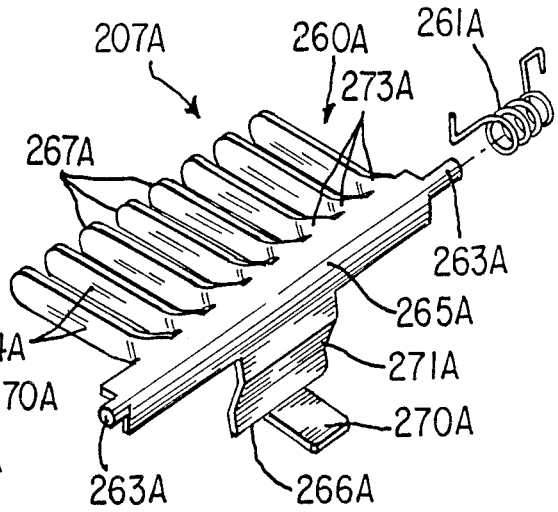
FIG-37
FIG-39
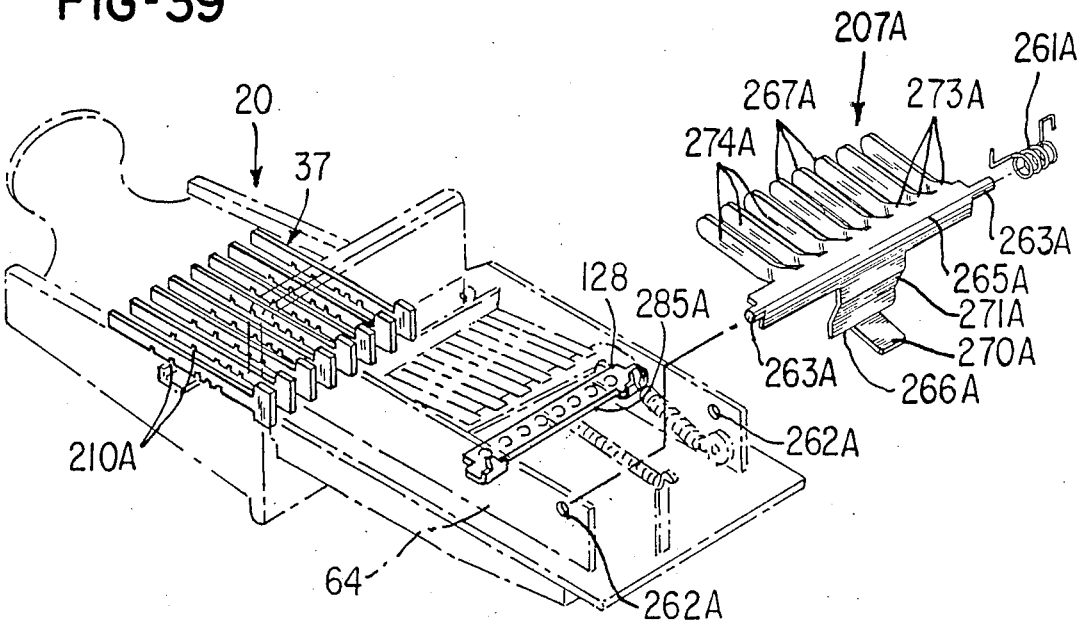

COIN CHUTE CONSTRUCTION

CROSS REFERENCE TO RELATED APPLICATION

This application is a continuation-in-part of copending U.S. application Ser. No. 928,878 filed Nov. 10, 1986 now U.S. Pat. No. 4,799,580 which is a division of Ser. No. 623,574 filed June 22, 1984 now U.S. Pat. No. 4,640,405.

BACKGROUND OF THE INVENTION

1. Field of the Invention

This invention relates to a coin chute construction and more particularly to such a construction for a dispensing machine which requires at least one coin of predetermined size and valuation to initiate one operation of such machine for one item of goods or service.

2. Prior Art Statement

It is known in the art to provide a construction which is referred to by various names including coin slide, coin-control operator, or coin chute construction and which is used to initiate one operation of a dispensing machine such as a dispensing machine which dispenses food, drink, or a commodity such as washing clothes or drying clothes, or the like. However, coin chute constructions proposed previously have deficiencies in that they can often be "cheated", i.e., flat elongate shims, slugs, or illegal coin shaped articles may be used to cause the machine to inititate one operation thereof. Previous constructions are often made such that one or more coins can be jammed in a slider of each so that the jammed coin(s) can be used to provide more than one operation of the dispensing machine. In addition such previous constructions are often comparatively easily jammed preventing normal operation thereof.

Applicant's U.S. Pat. No. 3,732,962 teaches a coin chute construction which comprises, a support body, a slider supported on the body for reciprocation in a rectilinear path between a fully retracted inoperative position and a fully advanced operative position thereof, at least one pocket in the slider for receiving a coin with the pocket being defined by surface means for supporting the coin so that upon moving the slider toward the operative position the coin is moved therewith to a test position and then toward the operative position. Such a construction also has test means at the test position for testing the coin for acceptability as to valuation and genuineness and when acceptable allowing full movement of the slider to the operative position enabling the slider to initiate the one operation of the machine, and the construction also has means operative upon failure of the coin to satisfy the test provided by the test means at the test position to thereby preclude the full movement to the operative position of such construction.

SUMMARY OF THE INVENTION

This invention provides an improved coin chute construction for a dispensing machine which requires at least one coin of predetermined size and valuation to inititate one operation of the machine for one item of goods or service and the construction comprises a support body, a slider supported on the support body for reciprocation in a rectilinear path between a fully retracted inoperative position and fully advanced operative position thereof, at least one pocket in the slider for receiving the coin, with the pocket being defined by surface means for supporting the coin so that upon moving the slider toward the operative position the coin is moved therewith to a test position and then toward the operative position. The construction also includes test means at the test position for testing the coin for acceptability as to valuation and genuineness and when acceptable allowing full movement of the slider to the operative position enabling the slider to initiate the one operation of the machine. The construction has means operative upon failure of the coin to satisfy the test provided by the test means at the test position to preclude the full movement to the operative position; and, the construction has means for providing curvilinear movement of the coin away from and then back toward the rectilinear path during movement of the slider from its inoperative position to the above-mentioned test position.

In accordance with one embodiment of this invention the providing means of the construction comprises baffle means and cooperating means for engaging and supporting each coin during curvilinear movement thereof to thereby assure precise introduction of each coin into the test means and wherein the cooperating means comprises means which engage top and bottom edges of each coin.

In accordance with another embodiment of this invention a coin chute construction is provided which employs improved adjustable bar means in its slider to blank out or adjust the size of coin opening means therein for various purposes including the provision of a coin knockout means if desired.

In accordance with another embodiment of this invention the coin chute construction may be provided with improved removable spring clips wherein each spring clip may be bent to accommodate coins of different denominations.

In accordance with another embodiment of this invention, a coin chute construction is provided which comprises coin knockout means at the operative position thereof operated by the slider and serving to push out of its pocket a coin which has been jammed therein so that another coin of the predetermined size and valuation is required to initiate another operation of the machine.

Accordingly, it is an object of this invention to provide an improved coin chute construction of the character mentioned.

Another object of this invention is to provide an improved method of making a coin chute construction of the character mentioned.

Other features, objects, uses, and advantages of this invention are apparent from a reading of this description which proceeds with reference to the accompanying drawings forming a part thereof.

BRIEF DESCRIPTION OF THE DRAWINGS

The accompanying drawings show present preferred embodiments of this invention, in which

FIG. 14 is a view similar to FIG. 1 illustrating another exemplary embodiment of the coin chute construction of this invention;

FIG. 15 is a top plan view of the coin chute construction of FIG. 14;

FIG. 16 is a view taken essentially on the line 16—16 of FIG. 15;

FIG. 17 is a view similar to FIG. 16 illustrating the pivoting manner in which the structure holding upper members at the coin test station may be pivoted in a clockwise direction;

FIG. 18 is a view showing the structure of FIGS. 16–17 urged downwardly as viewed in FIG. 15, by a spring;

FIG. 19 is a view of the structure shown in FIG. 18 urged upwardly to override its spring to thereby enable pivoting thereof from the position of FIG. 16 to the position of FIG. 17;

FIG. 20 is a view taken essentially on the line 20—20 of FIG. 15;

FIG. 25 is a view taken essentially on the line 25—25 of FIG. 20;

FIG. 26 is a view to a reduced scale similar to the illustration of FIG. 7 and taken essentially on the line 26—26 of FIG. 21;

FIG. 27 is an isometric view illustrating the clip support which is used at the coin test position and a pair of spare clips with one of such clips being in a storage position and the other being in spaced relation from the clip support;

FIG. 28 is a view taken essentially on the line 28—28 of FIG. 20 with parts broken away particularly illustrating U-shaped spring clips which may be utilized to hold pusher bars within their associated pockets;

FIG. 30 is a view similar to FIG. 14 illustrating a modification of the construction of FIG. 14 to provide coin knockout means;

FIG. 31 is a fragmentary view taken essentially on the line 31—31 of FIG. 30;

FIG. 32 is a view taken essentially on the line 32—32 of FIG. 31;

FIG. 33 is a view similar to FIG. 32 illustrating the action of coin knockout means engaging the coin to remove same from within its pocket;

FIG. 37 is an isometric view of the coin knockout means utilized in the coin chute construction of FIG. 30 and an associated spring employed therewith;

FIG. 38 is a plan view of a flat single piece blank used to make the coin knockout means of FIG. 37; and FIG. 39 is a view illustrating by dotted lines the coin chute construction of FIG. 1 and by solid lines illustrating only those components thereof which require modification or are to be newly added to the construction to provide same with coin knockout means.

DETAILED DESCRIPTION

Figure 1:
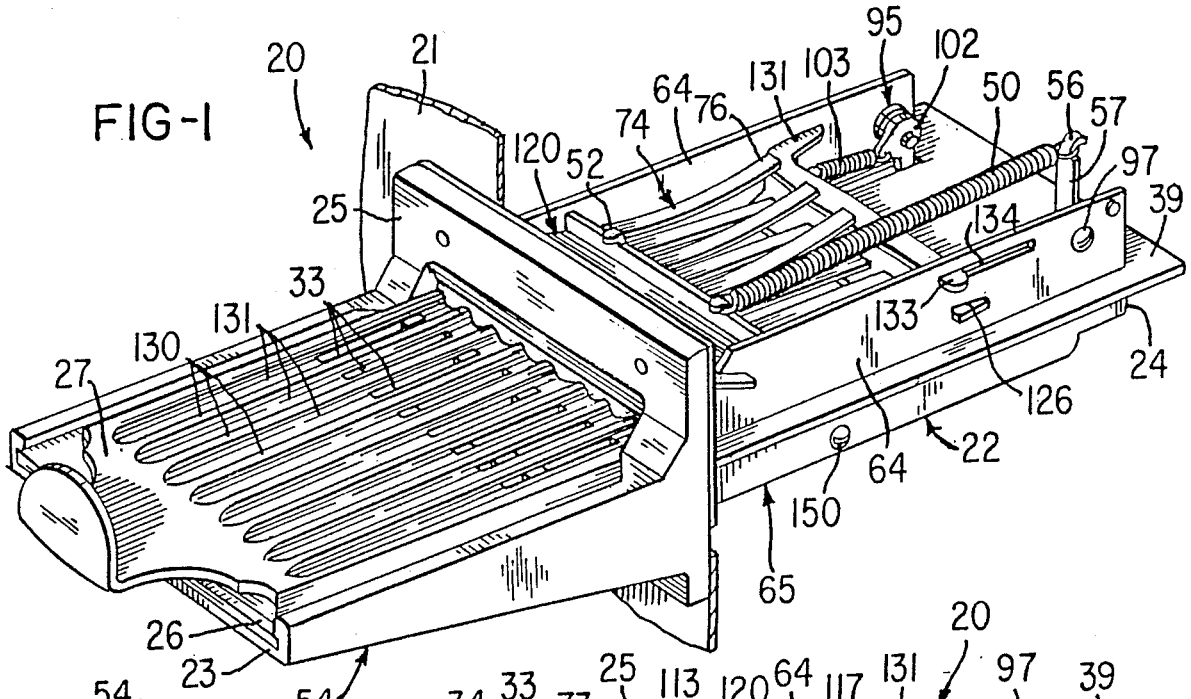
FIG. 1 is an isometric view illustrating one exemplary embodiment of the coin chute construction of this invention.

Reference is now made to FIG. 1 of the drawings which illustrates one exemplary embodiment of a coin chute construction of this invention which is designated generally by the reference numeral 20 and such construction is provided for an exemplary dispensing machine 21 and a fragmentary portion of such machine is illustrated in FIG. 1. The machine 21 may be of any suitable type known in the art in which a coin chute construction is utilized and may be in the form of a food or drink dispensing machine; or in the form of a commodity dispensing machine, such as, a clothes washer or dryer; or like machine. The machine 21 requires at least one coin of predetermined size and valuation to initiate one operation of such machine for one item of goods or service.

As seen in FIG. 1 of the drawings the coin chute construction 20 comprises a support body which is designated generally by the reference numeral 22 and the body 22 has opposite ends 23 and 24, a mounting plate 25, and a top face 26 defining runway means for a purpose to be subsequently described. The construction 20 also comprises a slider 27 supported on the top face 26 of the support body 22 for reciprocation in a rectilinear path P between a fully retracted inoperative position, shown at 30 in FIG. 3, and a fully advanced operative position, shown at 31 in FIG. 6.

Figure 2:
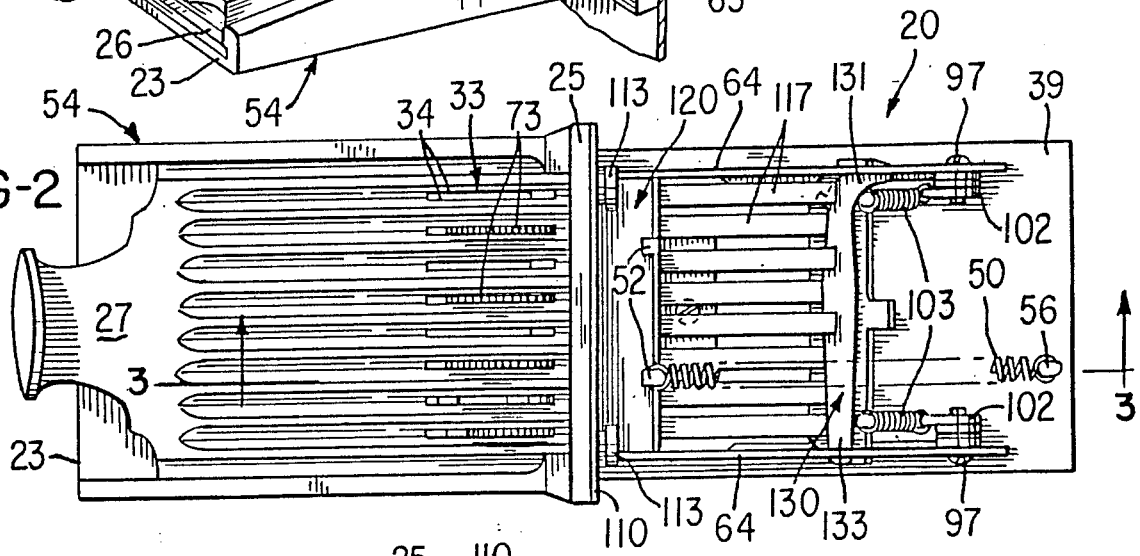
FIG. 2 is a top plan view of the coin chute construction of FIG. 1.

The slider 27 has at least one narrow elongate pocket therein; and, in this exemplary embodiment of the invention the slider has a plurality of eight pockets each designated by the reference numeral 33 and with only a few representative ones of such pockets being so designated. Each pocket 33 is provided in the slider 27 near the forward end thereof and for receiving an associated coin. Each pocket 33 is defined by surface means for supporting its associated coin in an edgewise manner and in this example of the invention such surface means and hence each pocket 33 is defined by a pair of side surfaces 34 in the slider (FIG. 2) and end surface means comprising an end surface portion 35 (FIG. 3) of slider 27 and an end surface portion 36 of an associated adjustable bar 37 of a plurality of such bars 37 comprising the slider 27 and the bars 37 will be subsequently described.

Figure 5:
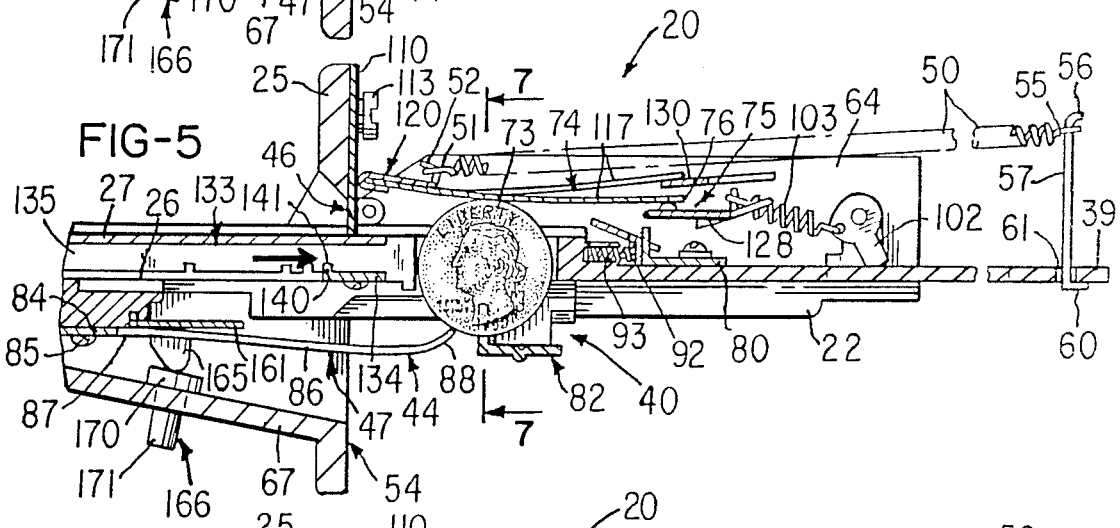
FIG. 5 is a view similar to FIG. 4 illustrating the coin in its test position for testing such coin for acceptability as to its valuation and genuineness.

The surface means defining each pocket supports each coin associated therewith so that upon moving the slider toward its operative position the coin is moved therewith to a test position shown at 40 in FIG. 5 and then to its fully advanced operative position 31. At position 31 each coin falls into the coin box and the end 39 of the slider actuates a suitable mechanism which is shown in this example as a depressable plunger 41 of a switch mechanism 42.

The construction 20 has test means at the test position 40 and such test means may be of any suitable type known in the art and will be described in more detail subsequently. The test means serves to test each coin in an associated pocket for acceptability as to valuation and genuineness and when acceptable the test means allows full movement of the slider 27 to the advanced operative position 31 whereby the plunger 41 is actuated causing the switch mechanism 42 to inititate one operation of the machine 21. The operation of the plunger 41, switch mechanism 42, and associated electrical and electromechanical components of the machine 21 are well known in the art and thus will not be described herein. The construction 20 also has means operative upon failure of one or more coins to satisfy the test provided by the test means at the test position 40 to preclude movement of the slider 27 to the advanced operative position 31.

Figure 3:
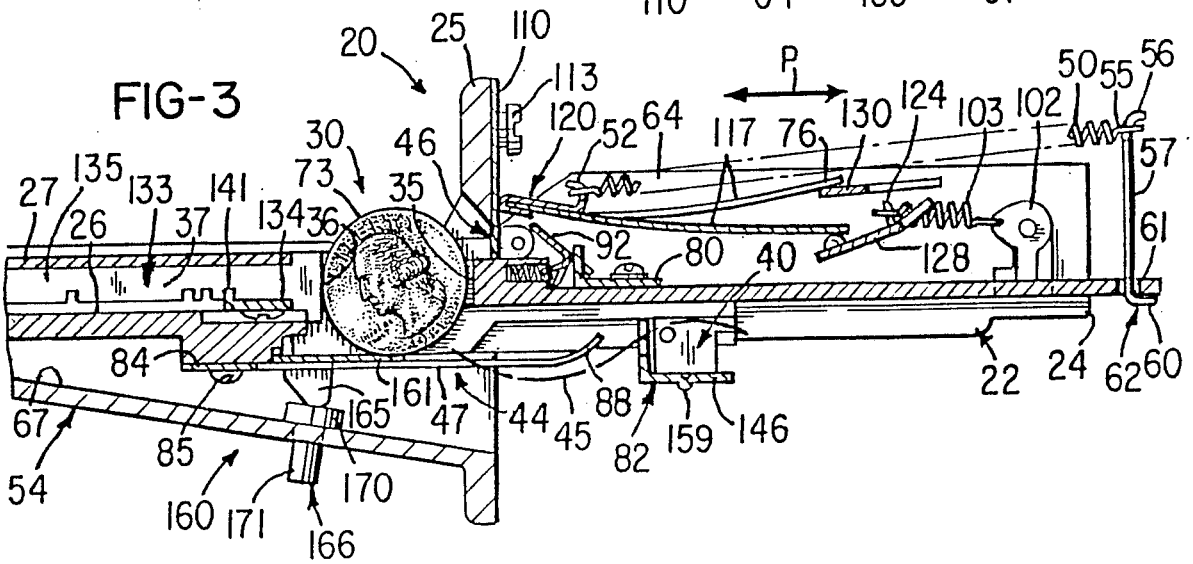
FIG. 3 is a cross-sectional view taken essentially on the line 3—3 of FIG. 2 and illustrating a coin inserted in an associated pocket of a slider of the coin chute construction and with slider in its fully retracted inoperative position.
Figure 4:
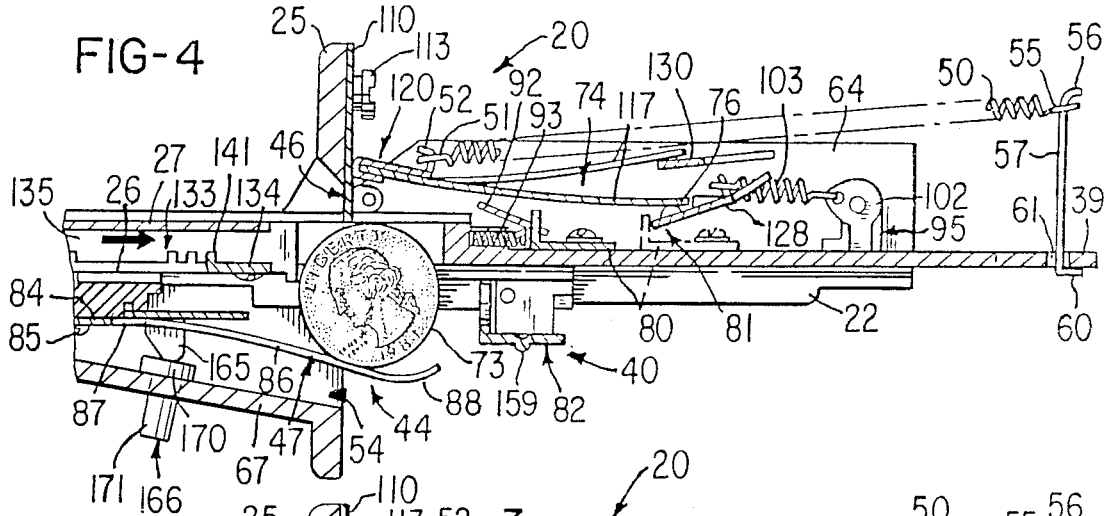
FIG. 4 is a view similar to FIG. 3 illustrating movement of the slider and coin toward its advanced operative position and with a coin disposed vertically under a baffle comprising baffle means of the coin chute construction.

In accordance with the teachings of this invention the construction 20 has means for providing movement of each coin away from and then back toward the previously mentioned rectilinear path P of the slider 27 during movement of the slider 27 from its inoperative position at 30 to the test position at 40; and, such providing means is illustrated in FIG. 4, for example, and designated generally by the reference numeral 44. The providing means 44 provides the above-mentioned movement of each coin away from and then back toward the rectilinear path P as a curvilinear movement and such curvilinear movement is shown by dotted lines in FIG. 3 of the drawings and designated by the reference numeral 45.

The providing means 44 comprises baffle means designated generally by the reference numeral 46 and cooperating yieldable spring means 47. In accordance with the teachings of this invention the providing means 44 and the curvilinear movement 45 cooperate to prevent shims or like objects from being used effectively to bypass the function of the test means at the test position 40. In addition, the providing means 44 also provides a self-cleaning action for foreign objects such as gum, toothpicks, putty-like materials, and the like from being urged against an outer surface of the slider 27 to thereby reduce the likelihood of jamming of the slider during the reciprocation thereof.

The construction 20 also has means for returning the slider from its fully advanced operative position 31 illustrated in FIG. 6 to its fully retracted inoperative position shown at 30 in FIG. 3 and such means comprises a spring 50 in the form of a tension spring which has one end 51 thereof attached to a hooking member 52 which is detachably fastened to side plates 64 which are supported by the mounting plate 25 as will be described subsequently.

The opposite end of the spring 50 has a looping end 55 which is in turn detachably fastened to a hooking portion 56 of a member 57 which is carried by the inner end of the slider 27. The member 57 has a hooking end 60 which extends through an opening 61 in the inner end of the slider 27 and is hooked in position as shown at 62 in FIG. 3. Thus, the spring 50 serves to retract the slider once the slider is moved from its fully retracted inoperative position shown at 30 in FIG. 3 to its fully advanced operative position shown at 31 in FIG. 6.

Figure 13:
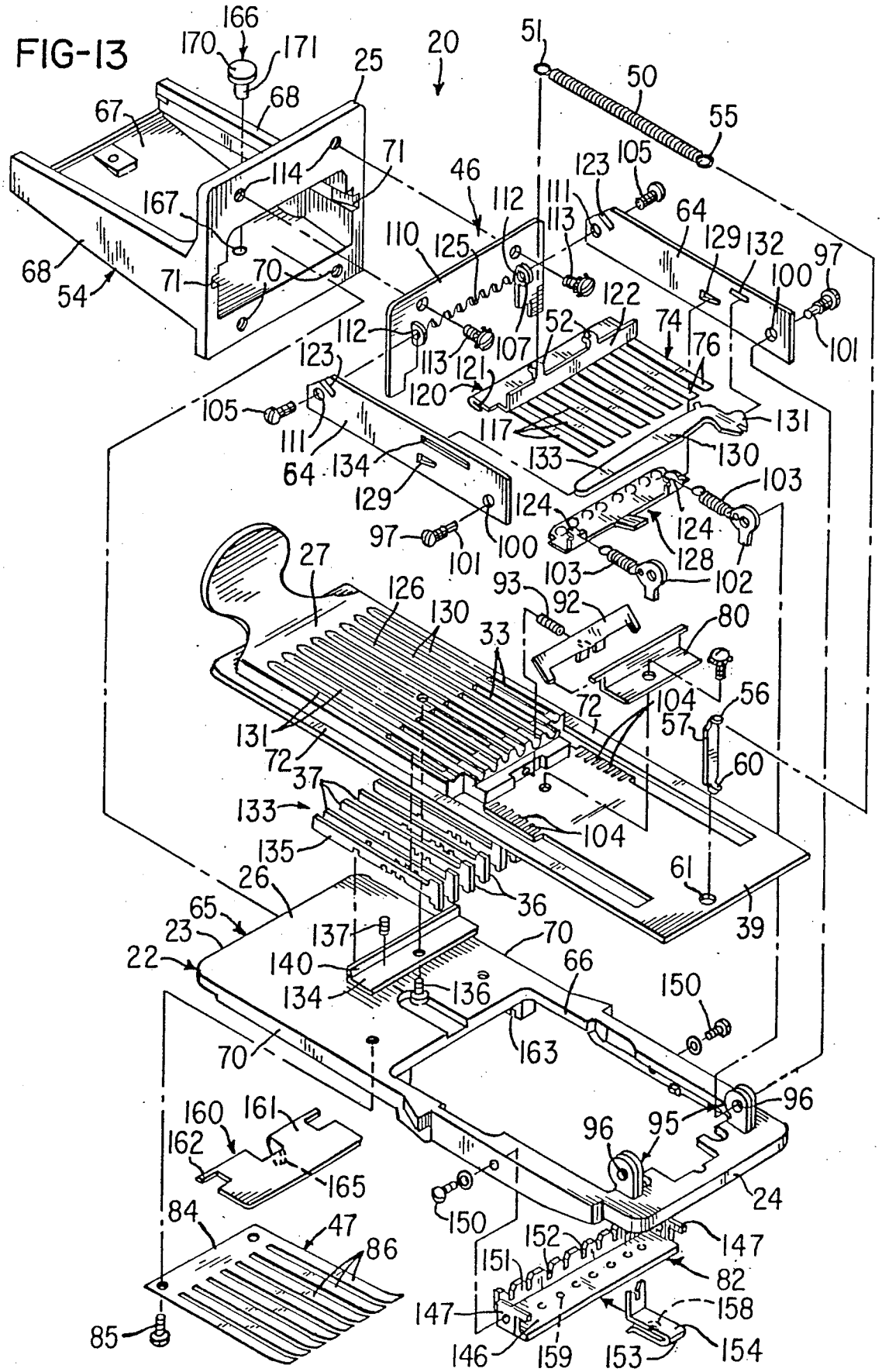
FIG. 13 is an exploded isometric view illustrating the various components of the coin chute construction of this invention.

As will be readily apparent from FIG. 13 of the drawings, the support body 22 is basically comprised of a plurality of two main parts and such main parts include a forward supporting portion 54 and an inwardly extending portion 65 which is provided with a comparatively large rectangular cutout 66 therein which receives coins from the slider once such coins have been found acceptable as to valuation and genuineness at the test position 40. The supporting portion 54 has a bottom wall 67 and a pair of side walls 68. The mounting plate 25 of the construction 20 is formed at the forward end of the walls 67 and 68 and as an integral single-piece structure therewith. The mounting plate has a plurality of two bottom threaded openings 70 for mounting same to the machine 21. The portion 65 has opposite side edges 70 suitably received and fixed in position in corresponding slots 71 in portion 54 and the upper parts of slots 71 also receive side edges 72 of the slider 27 and allow unobstructed movement of such slider along path P.

As previously mentioned the construction 20 has providing means 44 which provide the cirvilinear movement 45 which is illustrated by dotted lines in FIG. 3. The curvilinear movement makes it exceedingly difficult to insert thin elongate objects such as shims, toothpicks, and like items into the construction 20 to cheat same and cause operation of the machine 21 on which the construction 20 is used.

Figure 6:
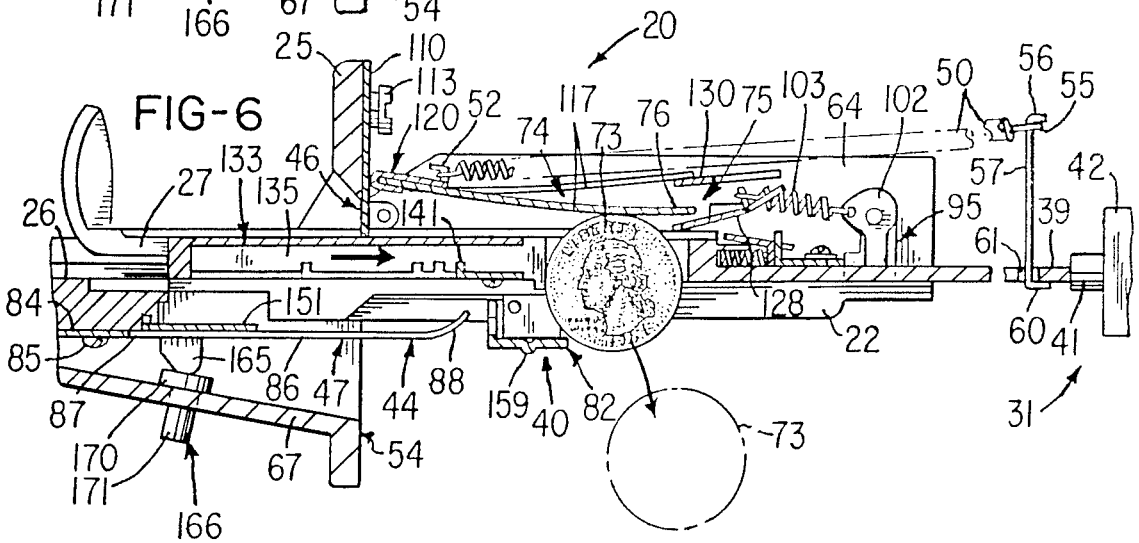
FIG. 6 is a view similar to FIG. 5 and illustrating the slider in its fully advanced operative position and with the now tested and accepted coin in position to drop in a coin box.
Figure 7:
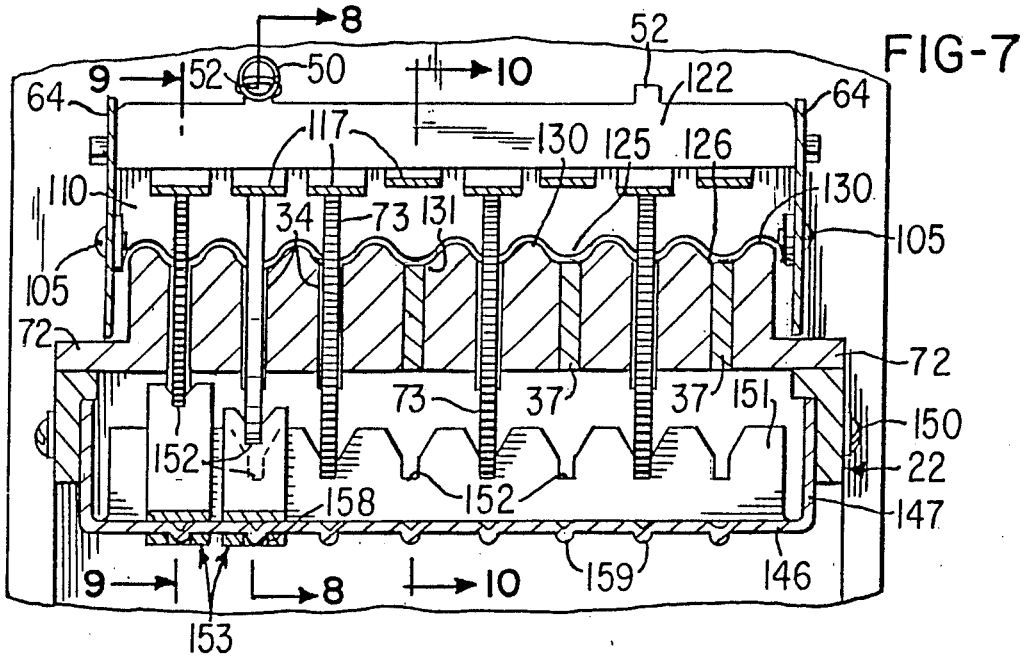
FIG. 7 is an enlarged fragmentary view taken essentially on the line 7—7 of FIG. 5.

However, in the normal operation of the construction 20 when a coin such as a United States twenty-five cent coin 73 is introduced into the construction (FIG. 3) and such coin 73 is moved into the test position 40, as shown in FIG. 5, and found acceptable, the operation of the construction 20 is such that an upper leaf spring structure 74 thereof has its inner end released as shown at 75 allowing the coin to be moved through the test position 40 and the slider to be moved to its fully advanced operative position shown at 31 in FIG. 6 whereby the switch mechanism 42 is actuated and causes the machine 21 to provide its dispensing function. If the coin 73 is found unacceptable as to genuineness and valuation the upper leaf spring structure 74 will not be released as shown at 75 and the coin 73 and slider 27 cannot be advanced.

It will be noted in FIG. 4 that prior to introduction of the coin into the test position 40 the inner end 76 of the leaf spring structure 74 is disposed downwardly in such a position that it engages a pivoted strip 128 whereby an L-shaped stop member 80 carried by the slider 27 engages the forward end thereof as shown at 81 preventing full advancing movement of the slider 27 to its fully advanced operative position 31.

Each coin which is inserted in the construction 20 is gauged between what will be referred to interchangeably as a gauge bar or gauge bar structure 82, as shown in FIGS. 4 and 13, and the upper leaf spring structure 74. Thus, as each coin is inserted in its pocket 33 in the slider 27 and moved from the inoperative position of the slider to the fully advanced operative position of such slider the coin is initially supported on yieldable spring means 47 previously described. The spring means 47 serves to support each coin inwardly of a plane defining the inside surface of the slider; and, in this example of the invention with the movement of the slider being horizontal, the yieldable spring means 47 supports each coin in a vertical direction. The yieldable spring means 47 provides for movement of each coin into the test position 40; and, such spring means 47 is in the form of a comb-like leaf spring structure 47 (FIG. 5) having one end 84 thereof fastened to the support body 22 and in particular to portion 65 of such support body by threaded screws 85, also see FIG. 13, whereby the spring means or spring structure 47 is fastened in a cantilevered manner. The spring structure has a plurality of spaced parallel members 86 each adapted to support a coin and each having a straight upstream portion 87 provided with an integral bridging part holding same together and defining the end 84 of structure 47. Each member 86 has an upwardly curved downstream portion 88 which is adapted to introduce its associated coin into the test means at the test position 40. Each coin is gauged between the gauge bar 82 and the upper leaf spring structure 74 whereby each coin is, in essence, gauged in a common plane disposed above the coin.

In this manner each advancing coin is disposed between the gauge bar 82 and the upper leaf spring structure 74 to a common level so that the top edges thereof are in the above-mentioned common plane which enables the determination of the valuation and genuineness of each coin with great precision. It will also be appreciated that by providing the gauging function such that, in essence, it is controlled at the top of each coin as the coin is advanced through the construction 20, the likelihood of being able to cheat the machine by inserting thin elongate objects, or the like, in the construction 20 is very small. It will be appreciated that the testing of the coins at the test position 40 by moving the coins so that the top edges thereof are in a common plane is essentially as taught in the above-referenced U.S. Pat. No. 3,732,962 and the applicable portions on this point and indeed the entire disclosure of this patent is incorporated herein by reference thereto. The above-mentioned patent teaches other features that prevent cheating and the introduction of slugs or other fake coins into a chute construction and the teachings of this patent are fully applicable to the coin chute construction 20.

After a coin or slug is introduced into the construction 20 and moved to the position shown in FIG. 4 the construction is in such a position that a skilled thief might attempt to insert a thin elongate object such as a shim, or the like, into the construction 20 in an effort to release the inner end 76 of the upper leaf spring structure 74 and allow advancement of the slider 27 without using the coin. To preclude this possibility it will be seen that a baffle 92 (see FIGS. 4 and 13) is pivotally detachably positioned forward of the stop 80. The baffle is yieldingly held with its forward end or portion urged upwardly by a compression spring 93 acting between the inner end of such baffle and a portion of the slider 27. The raised forward portion of the baffle 92 makes it virtually impossible to insert a thin elongate object, or the like, past the baffle 92 to cause release of the inner end 76 of the upper leaf spring structure 74.

The portion 65 of the support body 22 has a support lug structure in the inner end thereof and each lug structure is designated generally by reference numeral 95, as shown in FIG. 13. Each support lug structure or lug is a double thickness lug and has an opening 96 provided therein with the openings 96 being disposed on an axis which is disposed substantially perpendicular to the path of movement of the slider 27. Each lug 95 is adapted to have an associated side plate 64 suitably threadedly fastened thereto by a special screw 97 which will now be described.

Each screw 97 extends through an associated opening 100 in the inner end of its side plate 64 and a threaded portion of each screw 97 is adapted to engage cooperating threads defining the opening 96 to thereby fix the inner end of the side plate 64 against its associated lug 95. Each special screw 97 also has a smooth shaft portion 101 which extends inwardly beyond the inside surface of its associated side plate 64 and is adapted to pivotally support an associated pawl 102, which will now be described.

Each pawl 102 is biased by an associated tension spring 103 into engagement with a set of associated spaced parallel teeth 104 on the slider 27. The teeth 104 and pawl 102 define a pawl and ratchet arrangement of a type known in the prior art and as referred to in the above-mentioned U.S. Pat. No. 3,732,962. The function of the pawl and ratchet arrangement is well known in the art and assures unidirectional progressive full advancement of the slider to the operative position following a favorable coin test. This arrangement avoids artful manipulation of the slider 27 in an effort to obtain illicit operation of the machine with which the construction 20 is associated. Because such a pawl and ratchet arrangement is well known in the art it will not be further described herein.

As best seen in FIG. 13, each side plate 64 is fastened in position at its forward end, i.e., the end adjacent the mounting plate 25, by an associated threaded screw 105. Each threaded screw is threadedly received within lugs 107 of a unique baffle 110 which comprises the baffle means 46 and baffle 110 will be described subsequently. The lugs 107 have threaded openings 112 therein which are particularly adapted to receive an associated threaded screw and each threaded screw 105 extends through an associated opening 111 in a side plate 64 before being threadedly received within its threaded opening 112. The baffle 110 is fastened in position by threaded screws 113 which are provided with suitable lock nuts and the threaded screws are accessible only from the inside of the dispensing machine 21 inasmuch as the mounting plate 25 with its baffle 110 is mounted flush against a wall defining the machine 21. The threaded screws 113 are threadedly received within threaded openings 114 in the mounting plate 25.

Thus, the side plates 64 are held in position in a fixed manner at opposite sides of the support body and the slider 27 has suitable slots at opposite sides thereof to enable unobstructed sliding reciprocation of such slider in the previously mentioned rectilinear path P.

The construction 20 has its upper leaf spring structure 74 suitably supported by the side plates 64. The structure 74 is a comb-like structure consisting of a plurality of leaf springs each designated by the same reference numeral 117 and the springs are supported in a cantilevered manner by a support member 120 (FIG. 13) which, in essence, has a bifolded forward portion 121 which receives the upstream end of the leaf springs 117 in sandwiched relation between the bifolded portion thereby clamping and holding the springs 117 in position and in equally spaced parallel relation. Each spring 117 cooperates with an associated lower spring member 86 as also taught in the above-mentioned patent to control the movement of and provide testing of an associated coin therebetween.

The member 120 also has an upstanding portion 122 (FIGS. 3 and 13) provided with a pair of the previously mentioned hooking members each defined as an L-shaped hooking member 52. In this example of the invention, one of the hooking members has the forward hooking end 51 of the tension spring 50 hooked therearound in the manner previously described and for the purpose previously described. The member 120 has opposite ends thereof uniquely held in position by insertion thereof in a pair of slots 123 provided in the side plates 64. In this manner, the upper leaf spring structure 74 is held in position in a cantilevered manner by supporting the member 120 in associated slots 123 in the side plates 64.

As mentioned earlier, the construction 20 has a pair of pawls 102 which are provided for the purpose previously described. The pawls are spring loaded utilizing tension springs 103 and one end of each tension spring is fastened to its associated pawl by extending a portion thereof through an associated opening in the pawl provided for this purpose. Each tension spring 103 is fastened in position at its opposite end and thereby tensioned by looping a portion thereof around an associated hooking member 124 provided on a bar 128. The bar 128 has opposite end portions which are received within cooperating slots 129 in the side plates 64.

The construction 20 also has a roughly L-shaped member 130 which has one end 131 suitably received within a slot 132 in one of the plates 64 and has a long transverse arm portion 133 suitably received in a cooperating elongate slot 134 defined in an opposite side plate 64. The member 130 is provided for the purpose of supporting the individual springs 117 of the upper leaf spring structure 74 to assure and allow each coin engaging an associated spring 117 to pass therethrough in the event the coin engaged at the test station is found acceptable.

The construction 20 has means for providing movement of each coin away from and then back toward the previously described rectilinear path P during movement of the slider 27 from its inoperative position 30 to the test position. The baffle means 46 comprises previously mentioned baffle 110 which is detachably fastened to the mounting plate 25. The baffle 110 has what will be referred to as a first control surface 125 (FIG. 13) and the slider 27 has a second control surface 126 which is spaced a precise distance away from the first control surface to thereby allow the reciprocation of the slider 27 in an unobstructed manner. The precise distance referred to above between the first and second control surfaces is generally of the order of a few thousandths of an inch and it has been found that a spacing not exceeding four thousandths of an inch (0.004 inch) provides optimum results because it is very difficult to insert an effective tool in this small dimension.

The control surfaces 125 and 126 may have any suitable configuration; however, it is preferred that the control surfaces be defined by cooperating undulating or convoluted surfaces 125–126. Accordingly, the undulating surface 126 is such that it meshes precisely with the undulating surface 125 while allowing unobstructed reciprocation of the slider 27. Further, the utilization of undulating surfaces 125 and 126 makes it virtually impossible to insert even thin flat shims through the baffle means including the baffle plate 110 to cheat the construction 20. The surfaces 125–126 also prevent such shims from getting beyond the baffle 92 and to the area indicated at 75 in FIG. 5.

In this disclosure of the invention the slider 27 has been described as being provided with a plurality of elongate narrow pockets 33 each for receiving an associated coin and each as previously described. However, as described above, the second control surface or top surface 126 of slider 27 is an undulating surface and it will be appreciated that such surface is defined by alternating crests 130 and valleys or grooves 131, and as shown in FIG. 1. The elongate narrow pockets 33 are defined in the grooves 131.

The construction 20 utilizes unique means for adjusting, i.e. changing, the size for each elongate pocket 33 to accommodate coins of different sizes and valuation and such means will be referred to as pocket sizing means and designated generally by the reference numeral 133. The pocket sizing means 133 comprises a spring loaded plate 134 (FIG. 13) and a plurality of the previously mentioned adjustable bars 37 which are substantially identical. The plate 134 is detachably fastened to the bottom surface of the slider 27 by a threaded screw 136 which is received within a corresponding threaded opening provided in the slider 27. A compression spring 137 is disposed so that it acts between the inside surface of the plate 134 and the bottom surface of the slider 27 to yieldingly urge such plate outwardly and for a purpose which will be described subsequently. The spring loaded plate 134 is an L-shaped plate which has a main body portion and a leg 140 disposed transverse the main body portion with the leg adapted to be received within selected slots in each bar 37.

Each adjustable bar 37 is a roughly T-shaped bar having a transverse arm and an elongate leg 135. Each transverse arm has an outermost surface portion 36, which was previously described, and the surface portion 36 defines an end surface of an associated slot 33. As will be readily apparent from FIG. 13 of the drawings the leg 135 of each adjustable bar 37 has a plurality of slots therein and each slot is particularly adapted to have the leg 140 of the spring loaded plate 134 received therewithin so as to hold in position the associated bar along its pocket 33 and define the outermost surface portion of such pocket.

Figure 8:
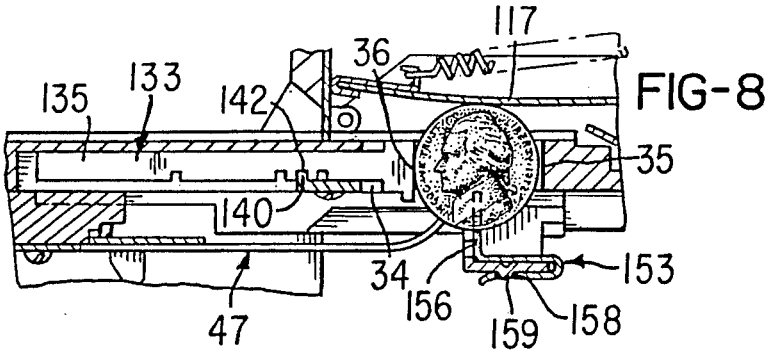
FIG. 8 is a fragmentary view similar to the central portion of FIG. 5 and taken essentially on the line 8—8 of FIG. 7 showing a five cent coin in its test position.

Accordingly, each bar 37 has an innermost slot 141 which will be referred to as its twenty-five cent slot, i.e., the slot associated with a twenty-five cent coin, slot 142 which will be referred to as its five cent slot, a slot 143 which will be referred to as its ten cent slot, and a slot 144 which will be referred to as its blanking slot. Thus, in the illustration of FIG. 5, for example, the twenty-five cent slot 141 is engaged by the leg 140 whereby the associated bar 37 is particularly adapted to be used with a twenty-five cent coin. In the illustration of FIG. 8 the five cent slot 142 is engaged by the leg 140 whereby the associated bar 37 is used with a five cent coin. Similarly, in the illustration of FIG. 9 the slot 143 is engaged by the leg 140 whereby the associated bar 37 is used with a ten cent coin. Finally, in the illustration of FIG. 10 it will be seen that the slot 144 is engaged by the leg 140 whereby the entire associated pocket 33 is blanked out.

The adjustable bars 37 are made so that the end surfaces 36 thereof are hardened end surfaces. It will be appreciated that in the normal operation of the construction 20 the adjustable bars 37 serve as pusher bars and the hardened surfaces are of such hardness that the serrations provided on various coins normally utilized in the construction 20 will not wear away such surfaces. Thus, the bars 37 may be considered as pusher bars having controlled hardness pusher surfaces 36.

In this example of the invention a plurality of eight pusher bars are utilized in association with the eight pockets provided in the slider 27. However, it is to be understood that the construction 20 may have any desired number of pockets and a corresponding number of pusher bars.

The pockets 33 as to number selected and size may be varied, as desired, to receive any desired combination of coins to provide the desired operation of the machine 21 and it is a simple matter to adjust the bars 37. Further, because of the manner in which the construction 20 is made each bar 37 may be slid and locked into position along its pocket 33 without removing same from the construction 20 and without removing the slide bar 27 from the housing. This is possible because of the easy accessibility of the underside of the slider and bars. Further, during adjustment of the bars 37 the spring-loaded plate 134 enables movement of such bars while keeping same assembled on the slider 27.

The bars 37 are preferably made of hard material such as steel, or the like whereby the surfaces 36 thereof are hardened surfaces. However, it is to be understood that in some applications of this invention it may be desired to make only the transverse arms of the T-shaped bars 37 of hardened material or the surfaces 36 may be defined as plated, or otherwise treated surfaces, to provide the desired hardness for same.

Thus, it is seen that the bars 37 provide a unique and versatile means for adjusting the number of coins required to initiate one operation of the machine 21. Further, the use of bars 37 make it possible for an unskilled mechanic to change the number and total value of coins for each operation of construction 20 as the need arises.

It should be emphasized that the operation of the construction 20 is such that all coins are brought into the test position 40 in a simultaneous manner and the upper leaf spring structure 74 must be operated by all required genuine coins at the same time. Unless and until all required genuine coins are in the test position 40 it is impossible to move the slider 27 from its inoperative position to its fully advanced operative position. Thus, if even one coin is not of the required valuation and genuineness it will be impossible to advance the slider 27 to the operative position 31. The operation of the construction 20 in this respect regarding the requirement that all coins be of the required genuineness and valuation is essentially the same as described in the above-mentioned patent.

Figure 9:
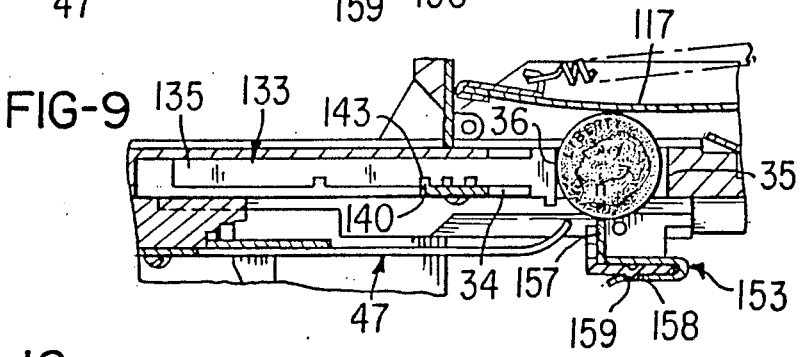
FIG. 9 is a fragmentary view similar to FIG. 8 and taken essentially on the line 9—9 of FIG. 7 showing a ten cent coin in its test position.
Figure 10:
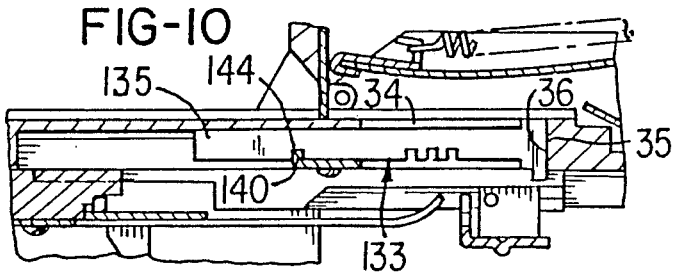
FIG. 10 is a view taken essentially on the line 10—10 of FIG. 7.

In this disclosure of the invention the various sizes of coins have been illustrated in FIGS. 5, 8 and 9 in the form of a twenty-five cent coin, five cent coin, and ten cent coin respectively. However, it will be appreciated that, if desired, a one cent coin may be utilized or a dollar coin if such becomes widely used. Further, the construction 20 lends itself to simple adjustments to accommodate coins of any country of the world.

In addition to the adjustable bars 37 described above, the construction 20 employs, at the test station 40, the previously mentioned coin gauge structure 82 which is a unique structure; and, the structure 82 is provided for accommodating coins of different sizes. The coin gauge structure comprises an L-shaped member 146 provided with integral side plates 147 and the member 146 is adapted to be fixed in position to the member 65 by threaded screws 150. The member 146 has an upstanding coin gauge arm 151 which is provided with precisely defined slots 152 having side surfaces which in this example are constructed and arranged to receive twenty-five cent coins therein so that with the member 146 fastened in position on the member 65 the surface means defining slots 152 are sized and arranged to receive twenty-five cent coins, provide precise gauging thereof, and allow passage of same through the test station 40.

However, in accordance with the teachings of this invention a plurality of L-shaped clips are provided for use in structure 82 and each clip is designated generally by the reference numeral 153, even though each may accommodate a different size coin. Each clip has a bifolded portion 154 which is identical to the bifolded portion of other clips and an upstanding portion which varies in length or extension depending on the size coin it is designed to gauge.

Thus, the upstanding portion for a five cent coin is designated by the reference numeral 156 in FIG. 8 and is of one dimension. The upstanding portion for a ten cent coin is designated by the reference numeral 157 in FIG. 9 and is longer than the upstanding portion 156. Each upstanding portion is tailored to the size of its associated coin. It will be appreciated that each upstanding portion is provided with associated surface means similar to the surface means 152 corresponding to its coin.

The clips 153 are easily installed in position on the member 146. In particular, each clip 153 is readily installed in position by a snap-fitting action and indeed each clip has an opening 158 therein in the bottom leg of its bifolded portion 154 which is adapted to receive therein a mating projection 159 extending from the underside of the member 146. Each clip 153 may be snap fitted in position by moving same into alignment over portion 146 with opposite members of the bifolded portion 154 on opposite surfaces of the member 146 and as indicated by the arrow in FIG. 13.

Figure 12:
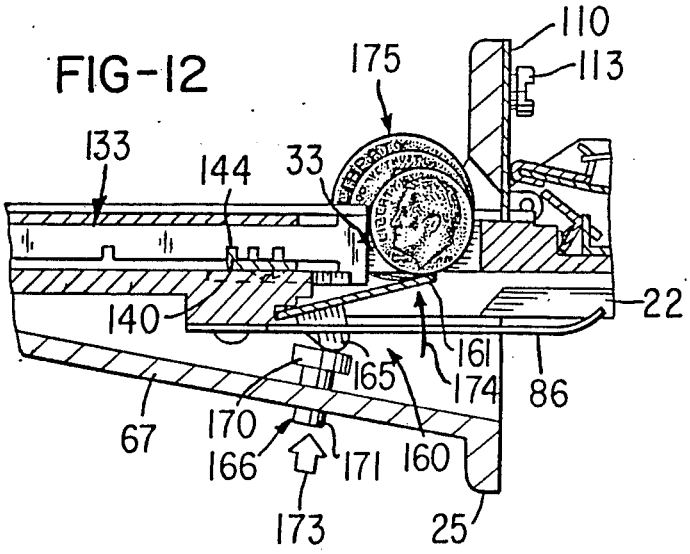
FIG. 12 is a view similar to FIG. 11 illustrating three coins in their associated pockets and further illustrating the operation of a coin inject mechanism.

The construction 20 has a unique coin eject mechanism or coin ejector which is designated generally by the reference numeral 160 which enables outward lifting of the coins inserted in associated pockets 33 (lifting vertically in this example) if a wrong size coin has been inadvertently placed in a pocket. The coin ejector 160 has a pivoted plate portion 161 which is pivoted by pivot members 162 received in associated slots 163 in the member 65. The plate 161 has a depending member 165 which extends beneath the bottom surface of its main body portion. A pusher button 166 is provided as a part of the coin ejector and the button 166 has a stem portion which is received within an opening 167 in the bottom wall 67 of the support member 54. The button 166 has a head 170 which limits the extent of downward movement thereof and the stem portion is a rod-like portion 171 which is freely movable within the opening 167. The pivoted member 161 is adapted to be moved upwardly by the head 170 engaging the depending portion 165 thereof upon being actuated manually by an operator desiring to retrieve a coin. In this manner it will be seen that coins provided in associated pockets 33 may be moved upwardly by applying of force as shown by the arrow 173 in FIG. 12 thereby urging the member 161 upwardly as shown by the arrow 174 whereby the coins are lifted as shown at 175 and easily grasped for removal from an associated pocket 33, if desired.

Figure 11:
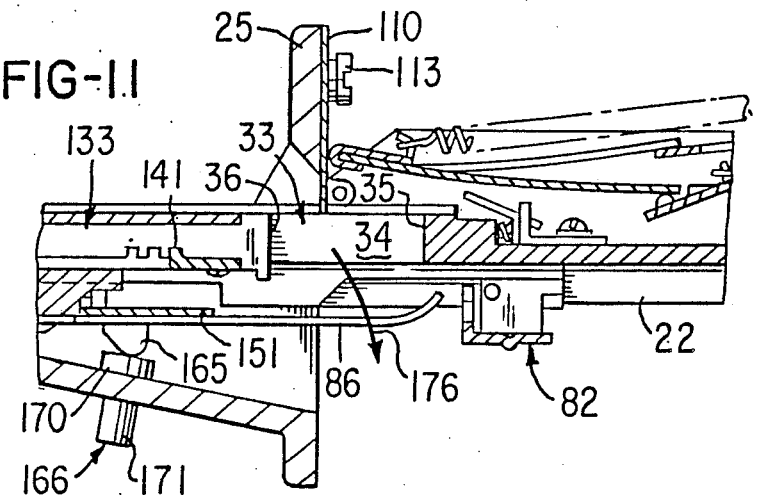
FIG. 11 is a view similar to the central portion of FIG. 3 with the coin removed and illustrating the manner in which foreign articles may be pushed through the slider of the coin chute construction in a harmless manner.

It will also be appreciated that the construction and arrangement of components of the construction 20 are such that putty, gum, toothpicks, paper, and the like which are shoved through the pockets 33 are easily moved between the teeth of the spring structure 47 and as shown by the arrow 176 in FIG. 11 also with the slider 27 in its retracted position such trash also tends to be moved between the end of the spring structure 42 and the structure at the test position 40.

In this disclosure of the invention it will be seen that the spring structure 42 acts as a grating having wider openings than the coin openings and thus make it self-cleaning of the trash, dirt and foreign objects in the manner mentioned. Also the gap between the ends of the springs of the spring structure and the structure at the test station serves the same function due to the space provided.

In the construction 20 the coins are gauged between the gauge bar and the upper set of leaf spring structure 74 as previously described. There is roughly an eight to one ratio of measurement which activates a stop common to all eight leaves of the spring structure. Further, in the event any one of these leaves of the spring structure is not properly actuated it is impossible to provide movement of the slider. In short, if one or more coins fails to pass the test at the test station the slider 27 is in a fully locked position whereby it cannot be advanced and the construction cannot be cheated.

It will also be appreciated that in this disclosure of the invention only one coin has been shown and utilized in association with an associated pocket. However, it is to be understood that a plurality of coins may be utilized in association with each pocket and as taught in the above-mentioned patent.

Another exemplary embodiment of the coin chute construction of this invention is illustrated in FIGS. 14–38 of the drawings. The coin chute construction of FIGS. 14–38 is very similar to the coin chute construction 20; therefore, such coin chute construction will be designated generally by the reference numeral 20A and representative parts of such coin chute construction which are similar to corresponding parts of the coin chute construction 20 will be designated in the drawings by the same reference numerals as in the coin chute construction 20 (whether or not such representative parts are mentioned in the specification) followed by the associated letter designation A and not described again in detail.

Only those component parts of the coin chute construction 20A which are substantially different from corresponding parts of the coin chute construction 20 will be designated by a new reference numeral also followed by the letter designation A and described in detail.

Figure 21:
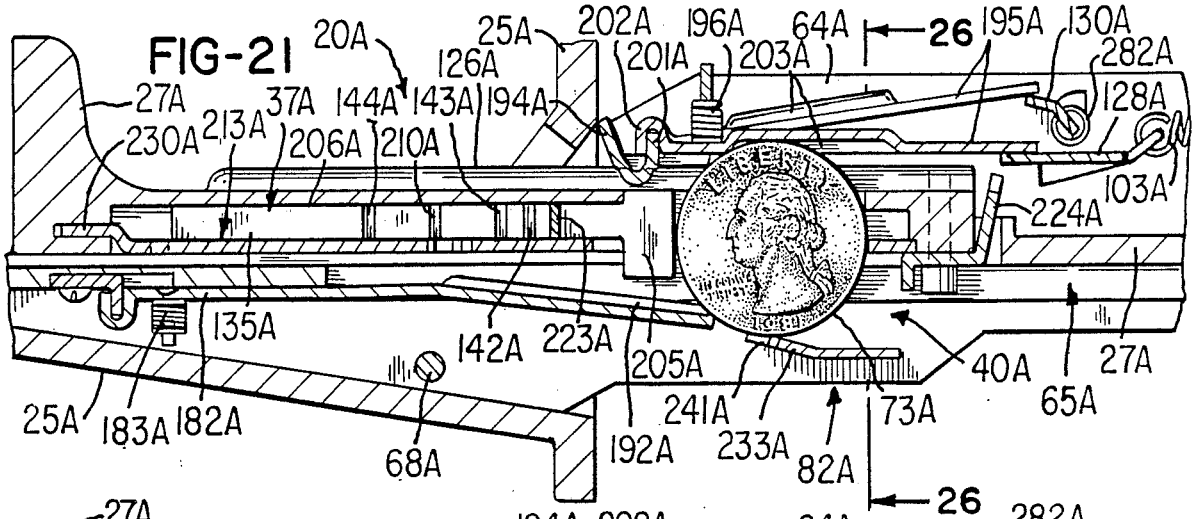
FIG. 21 is a view similar to FIG. 5 of the coin chute construction of FIG. 14 and showing a quarter at the coin test position.

The construction 20A has providing means 44A which provide the curvilinear movement 45A which is illustrated by dotted lines in FIG. 20. The providing means 44A comprises baffle means 46A and cooperating means 180A for engaging and supporting each coin during the curvilinear movement to thereby assure introduction of the coin into the test means at the test position 40A, as shown in FIG. 21.

Figure 29:
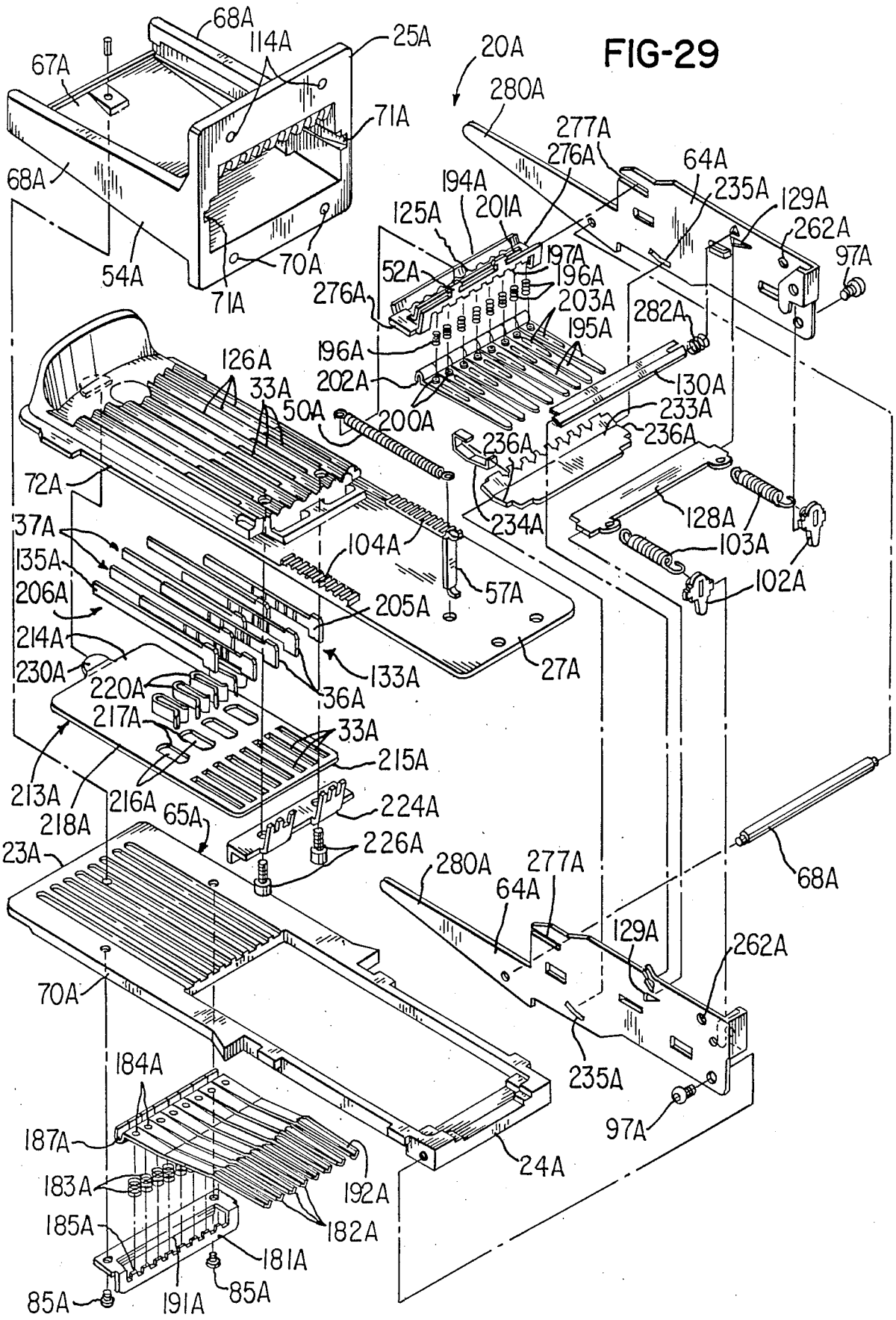
FIG. 29 is an exploded isometric view of the coin chute construction of FIG. 14 and which is similar to the view illustrated in FIG. 13.

As best seen in FIG. 29, the cooperating means 180A comprises a lower bracket 181A carried by and beneath the inwardly extending body portion 65A of the support body 22A, a plurality of lower elongate rigid members each designated by the same reference numeral 182A (and with only a representative few of such members 182A being so designated) supported by the lower bracket 181A, and a plurality of lower yieldable compression springs 183A each acting between the lower bracket 181A and an associated lower rigid member 182A with each lower rigid member 182A and lower yieldable compression spring 183A assuring introduction of an associated coin into the test means at the test position 40A in a precise manner.

Figure 24:
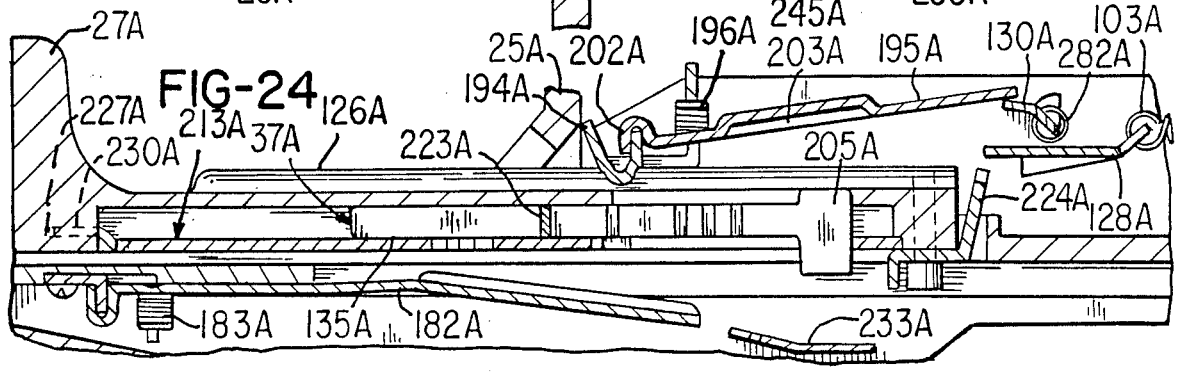
FIG. 24 is a view similar to FIGS. 21–23 showing the slider moved to its fully advanced position.

As best seen in FIG. 29 of the drawings and also in FIG. 24, each of the rigid members 182A has a projection 184A extending downwardly therefrom and similarly the lower bracket 181A has a plurality of projections 185A extending upwardly therefrom. Each projection 184A in a lower rigid member 182A is associated with a corresponding projection 185A in the bracket 181A and associated projections are adapted to receive an associated end of a compression spring 183A therearound to support and enable same to exert an upwardly directed yielding force against its associated lower rigid member 182A. Although each projection 184A may be made utilizing any suitable technique known in the art, each projection 184A in this example of the invention is made as a roughly tubular projection by punching action to define a punched part of the rigid member 182A.

Each lower rigid member 182A also has a concave arcuate surface 187A which is defined by a semicylindrical bend through the entire thickness at one end of each lower rigid member 182A. Similarly, the lower bracket 181A has a bearing surface in the form of a bearing edge 191A and each rigid member 182A is adapted to have its concave arcuate or semicylindrical surface 187A disposed or hooked around the edge 191A so as to bear and pivot thereagainst. With this arrangement, once the outer end of each member 182A is urged downwardly an associated compression spring 183A is compressed and the member 182A pivots about edge 191A due to engagement of the concave semicylindrical end against such edge. It will be appreciated that the dimensions and dimensional tolerances of cooperating parts are such that the outer end of each member 182A may be deflected or pivoted downwardly the desired amount without interference or binding between the bearing edge 191A and the surfaces adjoining such edge and the concave arcuate surface 187A.

As also seen in FIGS. 24 and 29, each lower rigid member 182A has a longitudinal channel 192A in the end thereof opposite from its pivoted end. The channel 192A is defined by forming the entire thickness of the associated end portion of the rigid member 182A and such channel is adapted to receive therein an associated edge of a coin which is to be introduced into the test means for such coin at the test position 40A.

As best seen in FIG. 29 and typically in FIG. 21, the construction 20A has an upper bracket 194A carried by and above the upper part of the support body 22A; and, construction 20A also has a plurality of upper rigid members each designated by the same reference numeral 195A. The members 195A are supported by the upper bracket 194A and the support body 22A; and, in particular, the side plates 64A which are fastened to the mounting plate 25A of the support body 22A. A plurality of upper yieldable compression springs 196A are also provided and each compression spring 196A acts between the upper bracket 194A and an associated upper rigid member 195A. Each upper rigid member 195A and upper yieldable compression spring 196A assures controlled engagement of an associated coin at the test position 40A.

In a similar manner as described for the lower bracket 181A, the upper bracket 194A has a plurality of projections 197A extending downwardly therefrom and each upper rigid member 195A also has an associated projection 200A extending therefrom. Each projection 200A in each upper rigid member 195A is preferably in the form of a tubular projection defined by punching action and as a punched part of the upper rigid member 195A. Each of the projections 200A in an upper rigid member 195A and an associated projection 197A in the upper bracket 194A is adapted to receive an associated end of an upper compression spring 196A therearound to support and enable same to exert a yielding force against its associated upper rigid member 195A.

The upper bracket 194A has a bearing surface in the form of a bearing edge 201A which serves in a similar manner as the bearing edge 191A in the lower bracket 181A. In particular, it will be seen that each upper rigid member has a concave arcuate surface 202A at the inner end thereof which is adapted to engage the bearing surface or bearing edge 201A and pivot thereagainst. The arcuate surface 202A in each upper rigid member 194A is preferably defined by a downwardly concave substantially semicylindrical bend through the entire thickness of the inner pivoted end of the upper rigid member 194A and it will be appreciated that the dimensional tolerance of the concave arcuate surface 202A is such that unobstructed pivoting movement of each upper rigid member 195A is possible as each upper rigid member 195A is yieldingly urged downwardly by an associated compression spring 196A so that the top edge of an associated coin is engaged by an associated upper rigid member 195A as such coin is introduced into the test position 40A.

Each upper rigid member 194A also has a longitudinal channel 203A in the central portion thereof which serves a dual purpose of providing added strength for the associated upper rigid member 195A and receiving an upper edge of an associated coin therewithin for optimum stabilization as the coin moves through the test position. Each channel 203A is defined in an associated member 195A by forming the entire thickness of the central portion of the associated member 195A using any suitable forming technique known in the art.

Figures 34, 35, 36:
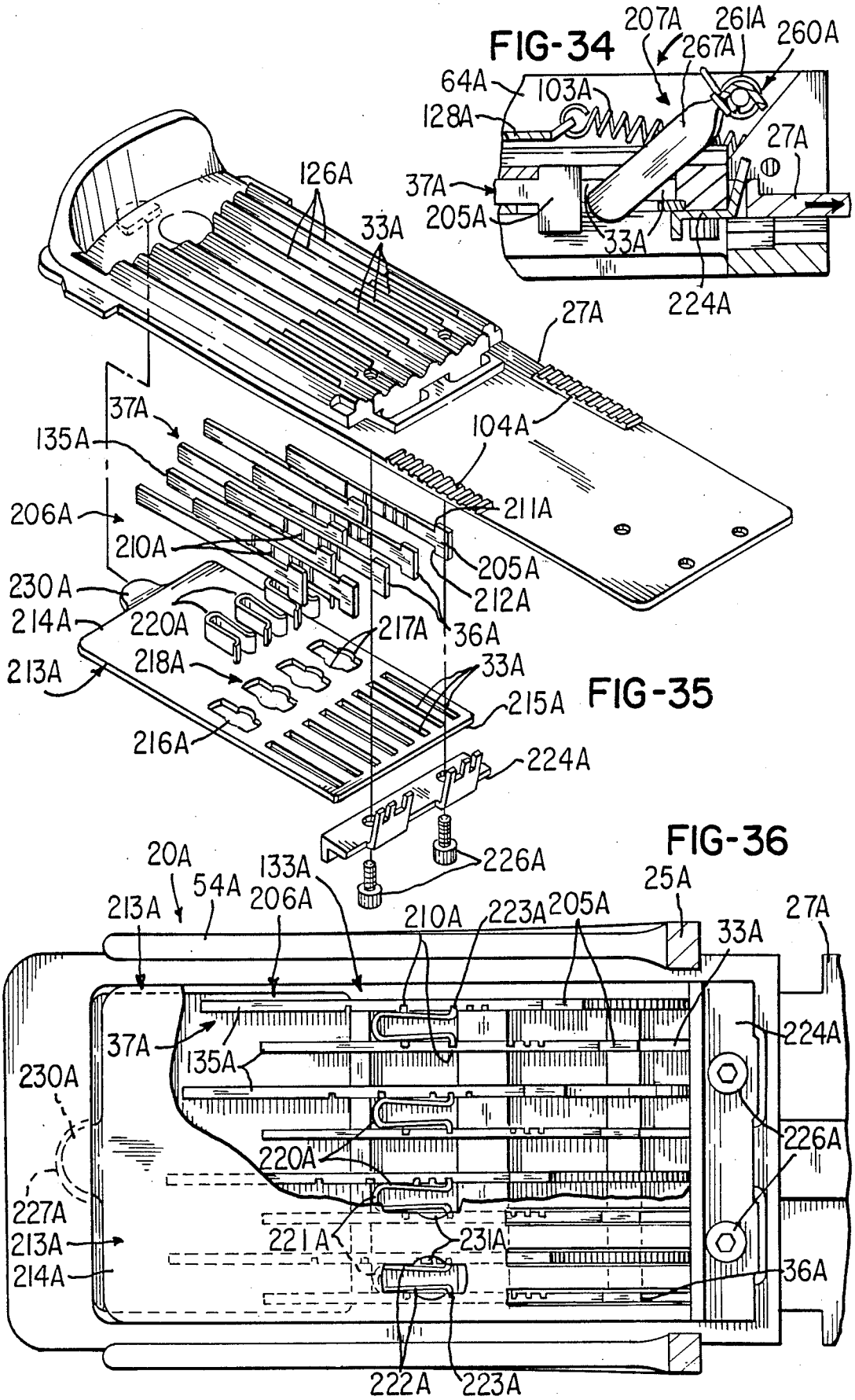
FIG. 34 is a view similar to FIGS. 32–33 illustrating the clearance between a coin pusher bar and an associated part of the coin knockout means when the associated coin receiving pocket has been blanked out so that a coin is not required therein.
FIG. 35 is an exploded isometric view showing details of the coin pusher bars and associated structure on a larger scale.
FIG. 36 is an enlarged plan view with parts in cross section and parts broken away particularly illustrating notches in the pusher bars and associated spring clips.

The construction 20A has pocket sizing means 133A, see FIGS. 29 and 36, and such pocket sizing means is provided for changing the size of each pocket 33A to accommodate coins of different size and valuation. The pocket sizing means in the construction 20A comprises a plurality of adjustable pusher bars 37A, with each of the bars being adapted to vary at least one dimension of an associated pocket 33A, and means for fastening each bar to the slider to provide for varying its associated dimension in a pocket 33A.

Each bar 37A is a roughly T-shaped bar having a transverse arm portion 205A and an elongate leg portion 135A coplanar therewith. Each transverse arm portion 205A has an outermost surface 36A which comprises the surface means defining an associated pocket and serves as a pusher surface for an associated coin upon moving the slider 27A toward the operative position previously described.

The leg portion 135A of each bar 37A has a plurality of slots therein which are disposed substantially in the plane of the arm and leg portions of the bar 37; and, in this instance such slots are disposed in a substantially vertical plane. The slots are disposed across the full width or height as viewed in the drawings, of the leg portion 135A; and, certain of the slots are placed along the leg portion based on the desired valuation and size of an associated coin to be used therewith enabling a portion of the said fastening means to be placed in an associated slot to position and hold the associated bar 37A at the desired position along its pocket 33A based on such valuation.

Referring now to FIGS. 21–24, it will be seen that each bar 37A has an innermost slot 141A (FIG. 22) which will be referred to as its 25 cent slot, a slot 142A (FIG. 21) which will be referred to as its 5 cent slot, a slot 143A (FIG. 22) which will be referred to as its 10 cent slot, and a slot 144A (FIGS. 21–23) which will be referred to as its blanking slot. The blanking slot 144A is used when an associated pocket is not to be used and is thus blanked out and the construction 20A does not use a coin knockout means. The coin knockout means is designated generally by the reference numeral 207A in the modification of the construction 20A shown in FIG. 30, for example, and will be described later in this disclosure. However, in instances where the coin knockout means 207A is utilized, each bar 37A has another slot 210A which is provided for a purpose to be subsequently described in detail.

Reference is now made to FIG. 35 of the drawings which is an enlarged illustration of the T-shaped bars 37A and it will be seen that each T-shaped bar has a transverse arm portion 205A as previously mentioned. Each transverse arm portion 205A extends different distances from opposite sides of its elongate leg portion 135A whereby it will be seen that each arm portion extends a distance 211A from the upper edge of its leg portion and a larger distance 212A from the lower edge of its leg portion. This arrangement assures that the outermost surface portion 36A of each pusher bar 37A is disposed within and defines its associated slot 33A upon fastening the bars 37A in position utilizing the fastening means 206A now to be described in detail.

As best seen in FIG. 35, the fastening means 206A comprises a plate 213A which has a forward end 214A, an inner end 215A, and a central part 218A provided with a plurality of openings 216A therein with each opening having a peripheral confining edge 217A. The fastening means 206A also comprises a plurality of spring clips 220A each disposed within an associated opening 216A (also see FIG. 36) and confined by associated confining edges 217A to hold the same to the plate 213A and slider 27A. Each spring clip 220A is a roughly U-shaped spring clip having a bight 221A and a pair of parallel legs 222A extending from the bight 221A and each parallel leg 222A has an outer lip 223A which is disposed in a selected slot in the leg portion 135A of an associated bar 37A to hold the associated bar at a desired position along its pocket 33A.

The fastening means 206A also comprises what will be referred to as a striker bracket 224A which is detachably fastened to the plate 213A and slider 27A. The striker bracket 224A serves to attach the inner end 215A of the plate 213A to the slider 27A utilizing a pair of threaded screws 226A which are received in associated threaded openings in the slider 27A.

As also seen in FIGS. 35 and 36, the fastening means 206A further comprises a cutout 227A in the forward end of the slider 27A and a projecting tongue 230A in the forward end of the plate 213A. The projecting tongue 230A is adapted to be received in the cutout 227A and fastens the forward end of the plate 213A to the forward end of the slider. The previously mentioned striker bracket 224A is detachably fastened by screws 226A to the inner end 215A of the plate 213A and to the slider 27A as previously mentioned. It will be appreciated that appropriate threaded openings are provided in the slider 27A to receive the threaded ends of the threaded screws 226A.

As mentioned earlier each of the U-shaped clips 220A has a pair of outer lips 223A which are disposed at the ends of its substantially parallel legs 222A. The lips 223A are disposed in selected slots of a pair of associated bars 37A to hold a pair of immediately adjacent bars at their desired positions along their associated pockets 33A and as is illustrated in FIG. 36. Each parallel leg 222A of each of the spring clips 220A is adapted to be yieldingly compressed to remove its outer lip from within an associated slot and thereby enable adjustment of an associated pusher bar 37A along its pocket and then a snap-fitting action of the removed outer lip 223A within another slot while keeping the slider 27A and its components assembled for reciprocation on the support body. Each of the openings 216A is adapted to receive a prying instrument, such as a common screw driver, between a peripheral confining edge thereof and a parallel leg of an associated spring clip to yieldingly compress same and enable its associated outer lip 223A to be removed from within an associated slot of an associated bar 37A and thereby enable the associated bar to be moved to a desired position along its pocket. A pair of typical locations, each designated by the same reference numeral 231A, at which a prying instrument may be inserted to yieldingly compress an associated leg 222A using edge 217A of associated opening 216A is shown in FIG. 36.

In a similar manner as described for the construction 20, the construction 20A has test means at the test position 40A that serves to test each coin in an associated pocket 33A for acceptability as to valuation and genuineness. The construction 20A comprises a coin gauge structure 82A at the test position 40A as seen in FIGS. 20–24. The coin gauge structure 82A comprises a clip support member 233A which is shown in isometric view in FIG. 27 and a plurality of bendable clips 234A for the smaller size coins which are detachably fastened thereto. Each of the clips 234A is adapted to support an associated coin thereon and each clip is bendable to accommodate coins of different sizes and valuation as required to provide one operation of the associated dispensing machine.

As previously mentioned, the support body 22A of the construction 20A has a pair of side plates or side plate portions 64A and the side plates have a pair of aligned slits therein, each designated by the same reference numeral 235A. The clip support 233A has a pair of opposed projections, each designated by the same reference numeral 236A, and as seen in FIGS. 27 and 29. The projections 236A at the opposite sides of the clip support 233A are adapted to be received in the slits 235A so that the clip support 233A is supported at its opposite sides by the side plates 64A supporting projections 236A.

As best seen in FIG. 27 of the drawings, the clip support 233A has a roughly saw-toothed configuration 237A at one end thereof defined by crests 240A and troughs 241A; and, each clip 234A is adapted to be disposed in snap-fitted relation in an associated trough 241A. The clip support 233A also has edge means 242A at its opposite ends enabling snap-locking storage thereon of a pair of spare clips; and, in the illustration of FIG. 27 one clip is shown at 243A snap-fitted to an associated edge means 242A. It will also be seen from the FIG. 27 showing that the clip support 233A has an angled configuration together with its projections 236A and the slits 235A in the side plates 64A are angled in a corresponding manner to receive the projections 236A therewithin.

Each clip 234A is a single piece member (FIG. 27) and comprises a base portion 245A corresponding in shape to the bottom surface 246A of the clip support 233A and is adapted to be disposed against such bottom surface 246A. Each clip 234A also has a rear hooking end 247A adapted to be hooked around the inner end of the clip support 233A, a forward riser 250A connected to the base portion 245A, and an upper portion 251A disposed over the base portion and roughly parallel thereto with the clip 234A installed in position, and as shown at 252A in FIG. 23 for example.

Figure 22:
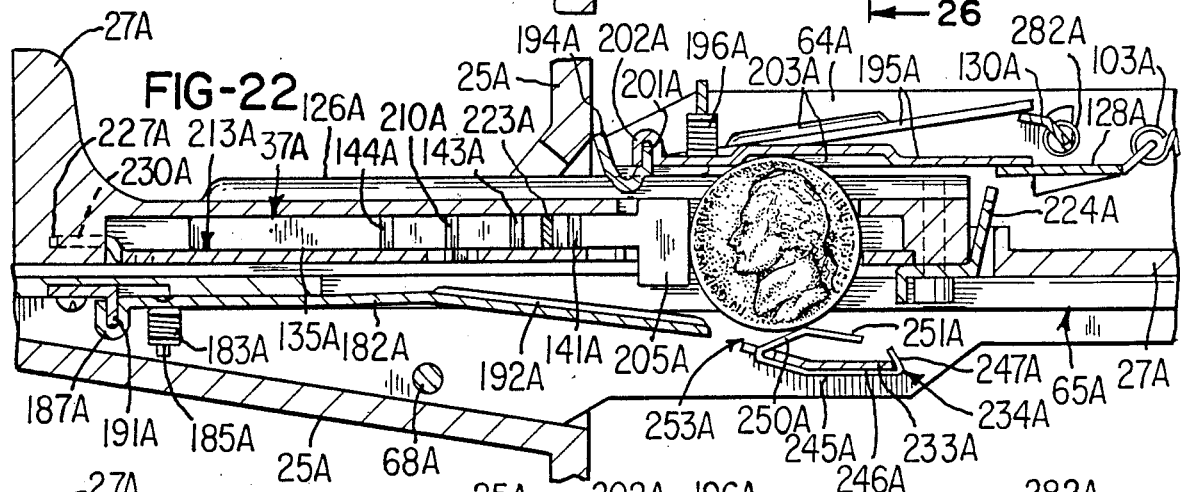
FIG. 22 is a view similar to FIG. 21 with a nickel at the coin test position.
Figure 23:
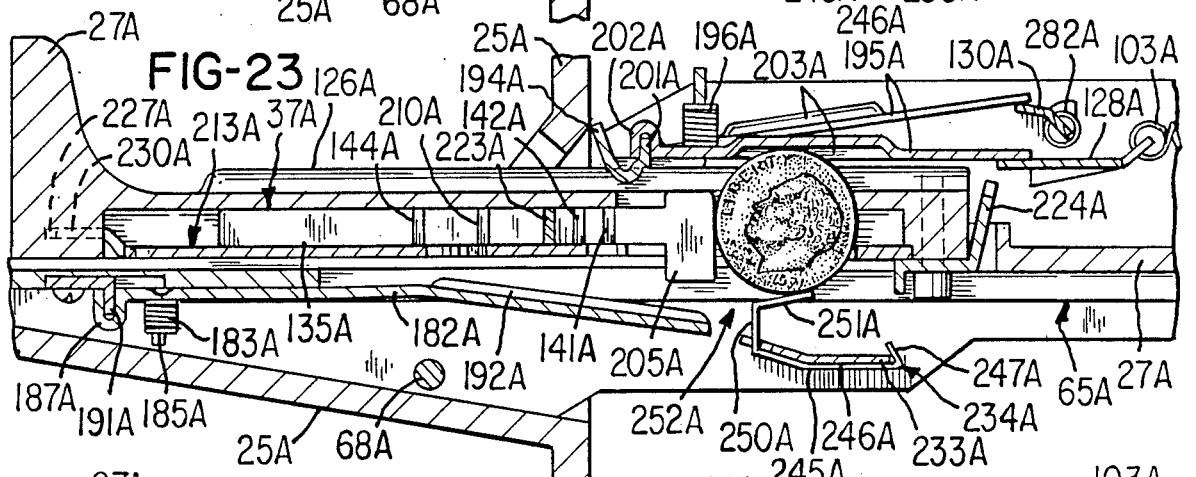
FIG. 23 is a view similar to FIG. 21 with a dime at the coin test position.

Each of the clips 234A is fastened to the clip support 233A having its riser 250A and upper portion 251A disposed to enable precise testing of a coin of predetermined size at the test station 40A and the riser is bendable to accommodate a coin which is of a different size than the predetermined size to enable precise testing of the said different size coin at such test station 40A. For example, in FIG. 23 the clip 234A is not bent and accommodates a dime at its test station 40; however, in the presentation of FIG. 22 the clip 234A has been bent to the position illustrated at 253A to accommodate a nickel in its test station. It will be appreciated that the construction of the clip 234A is such that it can be bent to compress the overall height thereof from the position of FIG. 23 to the position of FIG. 22 to accommodate a nickel where previously a dime was required and conversely can be bent from the position of FIG. 22 to the position of FIG. 23 to accommodate a dime where previously a nickel was required. The description in the next previous sentence was made to highlight the versatility of clips; however, it will be appreciated that the showings in FIGS. 22 and 23 illustrate the coins required in the associated slider pockets of the construction 20A of this example whereby a quarter is tested in an associated trough 241A as shown in FIG. 21 without requiring a clip 234A, a nickel tested as illustrated in FIG. 22 utilizing a clip 234A which has been bent as shown in 253A, and a dime is tested as illustrated in FIG. 23 utilizing a clip 234A which has not been bent. In each instance where a clip 234A is used it may be bent to compress same to accommodate a nickel or bent to expand same (if previously compressed) to accommodate a dime and thereby change the total value of coins required for one item of goods or services without the need to disassemble any of the construction 20A and merely by bending the clip support to the desired position. Of course, clips 234A may be easily installed on and removed from their support 233A without disassembly of the construction 20A to change the total value of coins required for one item of goods or services.

To facilitate the bending of a clip 234A, each clip has weakening means provided at the junction of its riser 250A with its base portion 245A. In particular, it will be seen in FIG. 27 that the weakening means comprises a pair of notches each designated by the same reference numeral 255A adjoining opposite sides of the junction of the riser 250A to the base portion 245A.

As previously mentioned, the construction 20A has coin knockout means 207A; and, such coin knockout means is illustrated in detail in FIGS. 30–34, 37 and 38. The coin knockout means 207A is provided at the operative position of the slider after full movement of such slider indicating that all coins have satisfied the test provided at the test means 40A. The coin knockout means is operated by the slider 27A and serves to push out of the pockets 33A the coins which have been jammed therein so that other coins each of the required predetermined size and valuation must be used in the pockets where coins were previously jammed to initiate another operation of the machine on which the construction 20A is utilized. It will be appreciated that a thief inclined to cheat the machine on which the construction 20A is utilized could fold a piece of paper 257A, or the like, as illustrated in FIGS. 30, 32, and 33 around an associated coin, typically a quarter as shown in these FIGS., whereby once the slider 27A is fully moved to its operative position the coin having passed the test means and having actuated the machine would not drop into a coin box usually provided on the machine associated with the construction 20A. In this manner, a thief could actuate the machine using jammed coins, retract the slider, and once an item of goods or services has been delivered by the machine simply repeat the operation utilizing the same jammed coin or coins. This could be repeated as many times as desired and then the coins could be removed from within their associated pockets. However, by using the coin knockout means 207A such cheating or robbery can be prevented.

The coin knockout means 207A comprises a pivoted knockout structure 260A (FIG. 37), spring means 261A yieldingly holding the knockout structure in an inoperative position and the striker bracket 224A previously described as holding the inner end of the plate 213A to the slider 27A and serving as a part of the fastening means 206A. As shown in FIGS. 32 and 33, the striker bracket is adapted to override the spring means or spring 261A and operate the knockout structure 260A upon moving the slider 27A to its operative position, which is the innermost or most advanced position of such slider.

As previously mentioned, the construction 20A has a pair of side plates 64A and the side plates have aligned bearing means 262A or cylindrical bearing surfaces therein (FIG. 29 adapted to support the knockout structure 260A for pivoting movement. The knockout structure 260A has a pair of bearing (FIG. 37 rod portions 263A at its opposite sides which are pivotally supported by the cylindrical bearing means or bearing surfaces 262A.

The knockout structure 260A has a central part 265A provided with the bearing rod portions 263A at its opposite ends, an extension 266A adjoining and extending from one edge of the central part 265A (with the extension being adapted to be engaged by the striker bracket 224A) and a plurality of blades 267A adjoining and extending from an opposite edge of the central part 265A with the blades being adapted to engage and push associated coins from within associated pockets. As will be readily apparent from FIGS. 37 and 38 of the drawings, the knockout structure 260A is a single piece structure made from a flat planar blank as illustrated in FIG. 38.

The central part of the planar blank is initially a flat rectangular part and is also designated by the reference numeral 265A and the central part 265A is formed into an L-shaped part with the rod portions 263A integrally formed at opposite ends thereof. The extension 266A is initially a flat T-shaped part also designated by the same reference numeral 266A which has a leg 270A and cross-arm portion 271A. The flat T-shaped part 266A is initially disposed coplanar with the flat rectangular central part 265A and the T-shaped part is formed with its arm portion at ninety degrees to its initial position and its leg portion 270A at ninety degrees thereto.

The plurality of blades 267A of the knockout structure 260A are initially a plurality of flat comb-like projections disposed coplanar with the flat rectangular part; however, such blades are formed with a twist shown typically at 273A at their bases so that each has a flat outer end perpendicular to the plane it was in prior to forming thereof. It will also be seen that each of the blades has parallel sides 274A terminating in an end of semicircular configuration when viewed perpendicular to the plane of the outer end.

The construction 20A also has means for providing movement of each coin away from and then back toward the previously described rectilinear path during movement of the slider 27A from its inoperative position to the test position. The baffle means in this instance comprises baffle means 46A. The baffle means 46A instead of utilizing the baffle 110 as in the case of the construction 20 utilizes the bracket 194A which has projections 276A at its opposite sides which are adapted to be received in cooperating grooves 277A in the side plates 64A whereby bracket 194A is held in a stationary position by the mounting plate 25A and a pair of side plate portions 64A fixed thereto. Each of the side plates 64A in this example has a roughly triangular extension 280A which is adapted to be fittingly received in the forward supporting portion 54A of the mounting plate 25A.

The bracket 194A has first control surface 125A provided thereon and in this example control surface 125A is defined in two portions disposed in spaced parallel relation due to the construction of the bracket 194A. The slider 27A has a second control surface 126A which is spaced a precise distance away from the first control surface to allow the previously described reciprocation of the slider 27A in an unobstructed manner. The control surfaces 125A and 126A are configurated as described previously and are defined as cooperating, undulating or convoluted surfaces which extend substantially in curved, undulating, or sinusoidal paths and as shown in FIGS. 25 and 26. As previously described, the utilization of undulating or convoluted surfaces 125A and 126A which extend in cooperating and meshing roughly sinusoidal paths make it virutally impossible to insert even thin flat shims through the baffle means to cheat the construction 20A.

The construction 20A may be provided without a coin knockout means as shown in FIG. 14, for example, or such construction may utilize the coin knockout means 207A as shown in the modification thereof presented in FIG. 30, for example. In the event a coin knockout means 207A is provided and the slider 27A has a pocket in which a coin is not to be inserted in providing one operation of the machine with which construction 20A is associated, an appropriate slot must be provided and used in the associated pusher bar so that a coin engaging blade 267A of the coin knockout means can travel through the associated pocket without engaging the associated pusher bar—see slot or notch 210A on FIG. 36, for example.

Referring now to FIGS. 15–19 in the drawings, it will be seen that the construction 20A also has a member 130A which is provided for the same purpose (previously described) as member 130 of construction 20. The member 130A in this example of the invention is adapted to be pivoted from the position of FIG. 16 to the position of FIG. 17 and the pivoting action may be achieved by compressing a spring 282A thereof (FIG. 15) as also shown in FIG. 19. Once the pivoting action is complete, the compression spring returns the member 130A to the position shown in FIG. 18 whereby the slot arrangement provided at opposite ends of the side plates 64A prevents further pivoting movement of the member 130A.

Reference is now made to FIG. 39 of the drawings which illustrates a modification of the construction 20 wherein the construction 20 utilizes a coin knockout means 207A. It will be appreciated that the coin knockout means 207A has integral portions thereof as previously described in detail in connection with the description of the coin knockout means 207A used on construction 20A. The coin knockout means 207A may be installed on the construction 20 with bearing portions 263A pivoted in cylindrical bearing surfaces 262A provided in the side plates 64 and also utilizing the spring 261A which normally holds the coin knockout means 207A in an inoperative position until it is engaged by a portion of the slider of the construction 20. To provide for clearance of the coin engaging fingers of the coin knockout means 207A, it will be seen that a suitable cutout 285A is provided on a member 128 of the construction 20A.

Except for the modification of member 128, the provision of cylindrical bearing surfaces 262A, and the utilization of coin knockout means 207A with its spring 261A the only other modification that is required in construction 20 to use the coin knockout means is a provision of a slot 210A in each of the pusher bars 37 to assure that the fingers of the coin knockout means 207A will clear the ends of the pusher bars in those instances where the coin pockets have been substantially blanked by the pusher bars 37. It will be appreciated that each slot or notch 210A in the pusher bars 37 is provided in the thickness of such pusher bar rather than in the plane of the transverse leg portion as described for the construction 20A.

Thus, it is seen that this invention provides an improved coin chute construction which is very difficult to be cheated by a thief utilizing various means. In addition, this invention provides an improved method of making such a coin chute construction.

Terms such as top, bottom, inner, outer and like terms have been used in this disclosure to describe the operation of certain items as shown in the drawings; however, it is to be understood that these terms are not to be considered limiting in any way.

While present exemplary embodiments of this invention, and methods of practising the same, have been illustrated and described, it will be recognized that this invention may be otherwise variously embodied and practiced within the scope of the following claims.

What is claimed is:

1. In a coin chute construction for a dispensing machine which requires at least one coin of predetermined size and valuation to initiate one operation of said machine for one item of goods or service, said construction comprising, a support body having an inwardly extending body portion, a slider supported on said support body for reciprocation in a rectilinear path between a fully retracted inoperative position and a fully advanced operative position thereof, at least one pocket in said slider for receiving said coin, said pocket being defined by surface means for supporting said coin so that upon moving said slider toward said operative position said coin is moved therewith to a test position and then toward said operative position, test means at said test position for testing said coin for acceptability as to valuation and genuineness and when acceptable allowing full movement of said slider to said operative position enabling said slider to initiate said one operation of said machine, means operative upon failure of said coin to satisfy the test provided by said test means at said test position to preclude said full movement to said operative position, and means for providing curvilinear movement of said coin away from and then back toward said rectilinear path during movement of said slider from said inoperative position to said test position, said providing means comprising baffle means and cooperating means for engaging and supporting said coin during said curvilinear movement to thereby assure introduction of said coin into said test means, the improvement in which said cooperating means comprises a lower bracket carried by and beneath said body portion, a lower elongate rigid member supported by said lower bracket and body portion, and a lower yieldable compression spring acting between said lower bracket and lower rigid member, said lower rigid member and lower yieldable compression spring assuring said introduction in a precise manner.

2. A construction as set forth in claim 1 in which each of said lower rigid member and lower bracket has an associated projection extending therefrom and each said projection is adapted to receive an associated end of said lower compression spring therearound to support and enable same to exert its yielding force against its associated lower rigid member.

3. A construction as set forth in claim 2 in which said projection in said lower rigid member is a roughly tubular projection defined by a punched part of said rigid member.

4. A construction as set forth in claim 2 in which said lower bracket has a bearing surface and said lower rigid member has an arcuate surface at one end thereof which is adapted to engage said bearing surface and pivot thereagainst.

5. A construction as set forth in claim 4 in which said arcuate surface is defined by a semicylindrical bend through the entire thickness of said one end of said lower rigid member.

6. A construction as set forth in claim 4 and further comprising a longitudinal channel in the end portion of said lower rigid member opposite from said one end wherein said channel is adapted to receive therein an associated edge of said coin for introduction into said test means.

7. A construction as set forth in claim 6 in which said channel is defined by forming the entire thickness of said opposite end portion.

8. A construction as set forth in claim 1 and further comprising an upper bracket carried by and above an upper part of said support body, an upper rigid member supported by said upper bracket and support body, and an upper yieldable compression spring acting between said upper bracket and upper rigid member, said upper rigid member and upper yieldable compression spring assuring controlled engagement of said coin at said test position.

9. A construction as set forth in claim 8 in which each of said upper rigid member and upper bracket has an associated projection extending therefrom and each of said projections in said upper rigid member and upper bracket is adapted to receive an associated end of said upper compression spring therearound to support and enable same to exert its yielding force against its associated upper rigid member.

10. A construction as set forth in claim 9 in which said upper bracket has a bearing surface, said upper rigid member has an arcuate surface at one end thereof which is adapted to engage said bearing surface of said upper bracket and pivot thereagainst, and said arcuate surface of said upper rigid member is defined by a semicylindrical bend through the entire thickness of said one end of said upper rigid member.

11. In a coin chute construction for a dispensing machine which requires at least one coin of predetermined size and valuation to initiate one operation of said machine for one item of goods or service, said construction comprising, a support body, a slider supported on said body for reciprocation in a rectilinear path between a fully retracted inoperative position and a fully advanced operative position thereof, at least one pocket in said slider for receiving said coin, said pocket being defined by surface means for supporting said coin so that upon moving said slider toward said operative position said coin is moved therewith to a test position and then toward said operative position, test means at said test position for testing said coin for acceptability as to valuation and genuineness and when acceptable allowing full movement of said slider to said operative position enabling said slider to inititate said one operation of said machine, means operative upon failure of said coin to satisfy the test provided by said test means at said test position to preclude said full movement to said operative position, means for providing curvilinear movement of said coin away from and then back toward said rectilinear path during movement of said slider from said inoperative position to said test position, pocket sizing means for changing the size of said pocket to accommodate coins of different size and valuation, said pocket sizing means comprising an adjustable pusher bar for varying at least one dimension of said pocket, and means for fastening said bar to said slider to provide for varying said one dimension, the improvement in which said bar is a roughly T-shaped bar, said bar having a transverse arm portion and a leg portion coplanar therewith, said transverse arm portion having an outermost surface which comprises a part of said surface means and serves as a pusher surface for said coin upon moving said slider toward said operative position, said leg portion having a plurality of slots therein which are disposed substantially in the plane of said arm and leg portions of said bar and across the full width of said leg portion, and certain of said slots being placed along said leg portion based on the valuation and size of an associated coin to be used therewith enabling a portion of said fastening means to be placed in an associated slot to position and hold said bar at the desired position along said pocket.

12. A construction as set forth in claim 11 in which said transverse arm portion extends different distances from opposite sides of said leg portion.

13. A construction as set forth in claim 11 in which said fastening means comprises a plate attached to said slider, said plate having an opening therein provided with peripheral confining edges, and a spring clip disposed within said opening and confined by said confining edges to hold same to said plate and slider, said spring clip having an edge disposed within a selected slot in said leg portion of said bar to hold said bar at said desired position along said pocket.

14. A construction as set forth in claim 13 in which said fastening means also comprises a striker bracket detachably fastened to said plate and slider, said striker bracket serving to attach an inner end of said plate to said slider.

15. In a coin chute construction for a dispensing machine which requires a plurality of coins of predetermined size and valuation to initiate one operation of said machine for one item of goods or service, said construction comprising, a support body, a slider supported on said body for reciprocation in a rectilinear path between a fully retracted inoperative position and a fully advanced operation position thereof, a plurality of pockets in said slider for receiving said coins, each of said pockets being defined by surface means for supporting its coin so that upon moving said slider toward said operative position its coin is moved therewith to a test position and then toward said operative position, test means at said test position for testing said coins for acceptability as to valuation and genuineness and when all coins are acceptable allowing full movement of said slider to said operative position enabling said slider to initiate said one operation of said machine, means operative upon failure of all coins to satisfy the test provided by said test means at said test position to preclude said full movement to said operative position, means for providing curvilinear movement of all coins away from and then back toward said rectilinear path during movement of said slider from said inoperative position to said test position, pocket sizing means for changing the size of each of said pockets to accommodate coins of different size and valuation, said pocket sizing means comprising a plurality of pusher bars, each of said bars being adapted to vary at least one dimension of an associated pocket, and means for fastening each bar to said slider to provide for varying its associated one dimension, each of said bars also being adapted to blank out an entire pocket, the improvement in which each bar is a roughly T-shaped bar, each bar having a transverse arm portion and a leg portion coplanar therewith, said transverse arm portion of each bar having an outermost surface which comprises a part of said surface means and serves as a pusher surface for an associated coin upon moving said slider toward said operative position, each bar having a leg portion which has a plurality of slots therein which are disposed substantially in the plane of said arm and leg portions of said bar and across the full width of said leg portion, certain of said slots being placed along said leg portion based on the valuation and size of an associated coin to be used therewith and one of said slots being a blanking slot, and said slots enabling a portion of said fastening means to be placed in an associated slot to position and hold its bar at the desired position along its pocket.

16. A construction as set forth in claim 15 in which said fastening means comprises a plate attached to said slider, said plate having a forward end, an inner end, and a plurality of openings therein each provided with peripheral confining edges; and a plurality of spring clips each disposed within an associated opening and confined by its confining edges to hold same to said plate and slider; each spring clip having an outer lip disposed within a selected slot in the leg portion of an associated bar to hold the associated bar at a desired position along its pocket.

17. A construction as set forth in claim 16 in which said fastening means comprises a cutout in the forward end of said slider, a projecting tongue in said forward end of said plate adapted to be received in said cutout, and a striker bracket detachably fastened to said inner end of said plate, said striker bracket serving to attach said inner end of said plate to said slider.

18. A construction as set forth in claim 16 in which, each of said spring clips is a substantially U-shaped clip which has a bight and a pair of substantially parallel legs extending from opposite ends of said bight, each of said legs terminates in an outer lip, and each of said spring clips with its outer lips within selected slots of a pair of associated bars serves to hold a pair of immediately adjacent bars at their desired positions along associated pockets.

19. A construction as set forth in claim 18 in which each parallel leg of each of said spring clips is adapted to be yieldingly compressed to remove its outer lip from within an associated slot and thereby enable adjustment of an associated bar along its pocket and snap-fitting of the removed outer lip within another slot while keeping said slider and its components assembled for reciprocation on said support body.

20. A construction as set forth in claim 19 in which each of said openings in said plate is adapted to receive a prying instrument between a peripheral confining edge thereof and a parallel leg of an associated spring clip to yieldingly compress same and enable its associated outer lip to be removed from within an associated slot of an associated bar and thereby enable said associated bar to be moved to a desired position along its pocket.

21. A construction as set forth in claim 20 in which said support body has a pair of side plates provided with a pair of aligned slits therein and said clip support has opposed projections at its opposite sides adapted to be received in said slits so that said clip support is supported at its opposite sides by said side plates supporting said opposed projections.

22. A construction as set forth in claim 21 in which said clip support has a roughly saw-toothed configuration at one end thereof defined by crests and troughs and each clip is adapted to be disposed in snap-fitted relation in an associated trough.

23. A construction as set forth in claim 22 in which said clip support has edge means at its opposite ends enabling snap-locking storage thereon of a pair of spare clips.

24. A construction as set forth in claim 22 in which each clip is a single piece member and comprises, a base portion corresponding in shape to the bottom surface of said clip support and is adapted to be disposed against said bottom surface, a rear hooking end adapted to be hooked around the inner end of said clip support, a forward riser connected to said base portion, and an upper portion disposed over said base portion and roughly parallel thereto, each of said clips when fastened to said clip support having its riser and upper portion disposed to enable precise testing of a coin of predetermined size at said test station and said riser being bendable to accommodate a coin which is of a different size than said predetermined size to enable precise testing of said different size coin at said test station.

25. A construction as set forth in claim 24 in which said riser has weakening means at its junction with said base portion to facilitate said bending.

26. A construction as set forth in claim 25 in which said weakening means comprises a pair of notches adjoining opposite sides of said junction.

27. In a coin chute construction for a dispensing machine which requires a plurality of coins of predetermined size and valuation to initiate one operation of said machine for one item of goods or service, said construction comprising, a support body, a slider supported on said body for reciprocation in a rectilinear path between a fully retracted inoperative position and a fully advanced operative position thereof, a plurality of pockets in said slider for receiving said coins, each of said pockets being defined by surface means for supporting its coin so that upon moving said slider toward said operative position its coin is moved therewith to a test position and then toward said operative position, test means at said test position for testing said coins for acceptability as to valuation and genuineness and when all coins are acceptable allowing full movement of said slider to said operative position enabling said slider to initiate said one operation of said machine, and means operative upon failure of all coins to satisfy the test provided by said test means at said test position to preclude said full movement to said operative position, the improvement comprising coin knockout means at said operative position operated by said slider and serving to push out of said pockets coins which have been jammed therein so that other coins each of the required predetermined size and valuation must be used in the pockets where coins were previously jammed to initiate another operation of said machine, said coin knockout means comprising a pivoted knockout structure and said construction further comprising spring means yieldingly holding said knockout structure in an inoperative position and a striker bracket on said slider which is adapted to override said spring means and operate said knockout structure, said support body having a pair of side plates, said side plates having aligned bearing means therein adapted to support said knockout structure for pivoting movement, and said knockout structure having a pair of bearing rod portions which are pivotally supported by said bearing means, said bearing means comprising a pair of right circular cylindrical openings defining corresponding right circular cylindrical surfaces on said bearing means, said knockout structure having a central part provided with said bearing rod portions at its opposite ends, an extension adjoining and extending from one edge of said central part, said extension being adapted to be engaged by said striker bracket, and a plurality of blades adjoining and extending from an opposite edge of said central part, said blades being adapted to engage and push associated coins from within associated pockets, said knockout structure being a single-piece structure made from a flat planar blank, said central part being initially a flat rectangular part and being formed into an L-shaped part with said rod portions integrally formed at the opposite ends thereof, said extension being initially a flat T-shaped part having a leg and a cross arm portion, said flat T-shaped part being initially disposed coplanar with said flat rectangular part and being formed with its leg portion at ninety degrees to its initial position, and said plurality of blades being initially a plurality of flat comb-like projections disposed coplanar with said flat rectangular part and being formed with a twist at their bases so that each has a flat outer end perpendicular to the plane it was in prior to forming thereof.

28. A construction as set forth in claim 27 in which each of said blades has parallel sides terminating in an end which has a semi-circular configuration when viewed perpendicular to the plane of said outer end.

* * * * *